US009200454B2

(12) United States Patent
Little et al.

(10) Patent No.: US 9,200,454 B2
(45) Date of Patent: Dec. 1, 2015

(54) TRIM BEAD AND STUCCO SYSTEM INCLUDING SAME

(71) Applicant: BASF Corporation, Florham Park, NJ (US)

(72) Inventors: Christopher K. Little, Suwanee, GA (US); Chris McElroy, Pinson, AL (US); William F. Egan, Ponte Vedra Beach, FL (US); David A. Smith, Middleburg, FL (US); Lei Zhao, Birmingham, AL (US)

(73) Assignee: BASF Corporation, Florham Park, NJ (US)

( * ) Notice: Subject to any disclaimer, the term of this patent is extended or adjusted under 35 U.S.C. 154(b) by 0 days.

(21) Appl. No.: 14/484,852

(22) Filed: Sep. 12, 2014

(65) Prior Publication Data

US 2014/0373470 A1 Dec. 25, 2014

Related U.S. Application Data

(60) Division of application No. 13/572,217, filed on Aug. 10, 2012, now Pat. No. 8,869,491, which is a continuation-in-part of application No. 13/291,563, filed on Nov. 8, 2011, now abandoned.

(60) Provisional application No. 61/411,125, filed on Nov. 8, 2010.

(51) Int. Cl.
*E04F 13/06* (2006.01)
*E04F 13/04* (2006.01)
(Continued)

(52) U.S. Cl.
CPC ..... *E04F 13/045* (2013.01); *E04F 13/06* (2013.01); *E04F 13/072* (2013.01); *E04F 13/073* (2013.01); *E04F 2013/065* (2013.01)

(58) Field of Classification Search
CPC ..... E04F 13/06; E04F 13/068; E04F 19/02; E04B 1/765; E04B 1/762
USPC ..... 52/745.05, 745.06, 745.09, 745.12, 52/255, 302.1, 302.3, 58, 302.6, 443, 447, 52/716.1, 718.01, 716.8, 342, 371, 846
See application file for complete search history.

(56) References Cited

U.S. PATENT DOCUMENTS 1,310,331 A * 7/1919 Ficklen ..... 404/8
1,389,057 A * 8/1921 Lavigue ..... 52/127.6
(Continued)

FOREIGN PATENT DOCUMENTS

CA 2259875 * 10/1999 ..... E04C 2/00
EP 0856614 A1 * 1/1998 ..... E04B 1/76

OTHER PUBLICATIONS

International Search Report, Form PCT/ISA/210 for PCT International Patent Application No. PCT/EP2011/069588, mailing date Feb. 27, 2012.
(Continued)

*Primary Examiner* — Brent W Herring
(74) *Attorney, Agent, or Firm* — Curatolo Sidoti Co., LPA; Salvatore A. Sidoti; Daniel E. Moderick, Jr.

(57) ABSTRACT

A trim bead for a building wall incorporates an outwardly extending flange portion to provide a mechanical key for a layer of exterior finishing coatings, such as stucco coatings. The trim bead may be used in stucco systems for exterior building walls that employ continuous thermal insulation over the building wall substrate.

29 Claims, 5 Drawing Sheets

(51) Int. Cl.
*E04F 13/073* (2006.01)
*E04F 13/072* (2006.01)

(56) References Cited

U.S. PATENT DOCUMENTS

| | | | | |
|---|---|---|---|---|
| 1,419,232 | A | 6/1922 | Curtis | |
| 1,624,121 | A * | 4/1927 | Thiem | 52/371 |
| 2,073,185 | A * | 3/1937 | Shafer | 52/293.3 |
| 2,483,888 | A * | 10/1949 | Danielson | 52/35 |
| 3,004,640 | A | 10/1961 | Macomber | |
| 3,242,622 | A | 3/1966 | Snead | |
| 3,494,085 | A | 2/1970 | Bael | |
| 3,672,108 | A | 6/1972 | Conway | |
| 3,754,367 | A | 8/1973 | O'Konski et al. | |
| 4,550,535 | A | 11/1985 | Drogosch | |
| 4,912,899 | A | 4/1990 | Plasker et al. | |
| 4,986,051 | A | 1/1991 | Meyer et al. | |
| 5,003,743 | A | 4/1991 | Bifano et al. | |
| 5,063,720 | A | 11/1991 | Bifano et al. | |
| 5,243,797 | A | 9/1993 | Koenig, Jr. | |
| 5,417,028 | A | 5/1995 | Meyer | |
| 5,444,953 | A * | 8/1995 | Koenig et al. | 52/282.1 |
| 5,579,623 | A | 12/1996 | Stark et al. | |
| 5,625,986 | A * | 5/1997 | Mansfield et al. | 52/255 |
| 5,630,297 | A * | 5/1997 | Rutherford | 52/58 |
| 5,699,638 | A | 12/1997 | Maylon | |
| 5,771,653 | A | 6/1998 | Dolati et al. | |
| 5,816,012 | A | 10/1998 | Willis | |
| 5,836,135 | A | 11/1998 | Hagan et al. | |
| 5,865,008 | A * | 2/1999 | Larson | 52/690 |
| 5,875,604 | A * | 3/1999 | Rudd | 52/481.1 |
| 5,937,600 | A | 8/1999 | Larson | |
| 5,946,870 | A | 9/1999 | Bifano et al. | |
| 5,966,891 | A | 10/1999 | Fagan et al. | |
| 5,970,671 | A | 10/1999 | Bifano et al. | |
| 5,979,123 | A * | 11/1999 | Brockman | 52/101 |
| D425,999 | S | 5/2000 | Belk | |
| 6,108,991 | A | 8/2000 | Hagan et al. | |
| 6,119,429 | A | 9/2000 | Bifano et al. | |
| 6,134,847 | A | 10/2000 | Bifano et al. | |
| 6,145,255 | A | 11/2000 | Allaster | |
| 6,189,273 | B1 | 2/2001 | Larson | |
| 6,199,341 | B1 * | 3/2001 | Carlin et al. | 52/653.1 |
| 6,260,327 | B1 * | 7/2001 | Pellock | 52/643 |
| 6,282,851 | B1 | 9/2001 | Beaton | |
| 6,293,064 | B1 | 9/2001 | Larson | |
| 6,298,609 | B1 | 10/2001 | Bifano et al. | |
| 6,338,229 | B1 * | 1/2002 | Botzen | 52/371 |
| D459,007 | S | 6/2002 | Campacci | |
| 6,410,118 | B1 | 6/2002 | Reicherts et al. | |
| 6,421,971 | B1 | 7/2002 | Gembala | |
| 6,470,638 | B1 | 10/2002 | Larson | |
| 6,505,455 | B1 * | 1/2003 | Georgeau | 52/746.11 |
| 6,526,707 | B2 | 3/2003 | Tucker | |
| 6,591,566 | B1 | 7/2003 | Rodlin | |
| 6,698,144 | B1 | 3/2004 | Larson | |
| 6,817,155 | B2 | 11/2004 | Larson | |
| D503,227 | S | 3/2005 | Rodolfo et al. | |
| D503,469 | S | 3/2005 | Rodolfo et al. | |
| 6,964,140 | B2 | 11/2005 | Walker et al. | |
| 7,036,284 | B1 | 5/2006 | Larson | |
| 7,546,719 | B1 * | 6/2009 | Guevara | 52/716.2 |
| 7,721,489 | B1 * | 5/2010 | Inzeo | 52/95 |
| 7,921,537 | B2 | 4/2011 | Rodlin | |
| 8,141,318 | B2 | 3/2012 | Dunbar et al. | |
| D700,717 | S * | 3/2014 | Campacci | D25/119 |
| 2002/0005023 | A1 | 1/2002 | Ford | |
| 2003/0126826 | A1 | 7/2003 | Marshall et al. | |
| 2006/0254169 | A1 * | 11/2006 | McFadden | 52/344 |
| 2006/0277854 | A1 | 12/2006 | Egan | |
| 2007/0062137 | A1 | 3/2007 | Maylon | |
| 2008/0104918 | A1 * | 5/2008 | Gleeson et al. | 52/489.1 |
| 2010/0132288 | A1 | 6/2010 | Hines | |
| 2010/0287863 | A1 * | 11/2010 | Goldberg et al. | 52/302.1 |
| 2012/0110936 | A1 | 5/2012 | Egan et al. | |
| 2012/0272590 | A1 * | 11/2012 | Goldberg et al. | 52/169.14 |

OTHER PUBLICATIONS

Written Opinion, Form PCT/ISA/237 PCT International Patent Application No. PCT/EP2011/069588, mailing date Feb. 27, 2012.

Windlock "Universal Starter Track—Jobsite Inventory Control"; 4 pages; downloaded Sep. 28, 2010.

DurRock—Track product description, published 2006; 1 page.

Amico Product Sheet; "Vinyl>Drywall>"J" Bead"; 2 pages; http://www.amico-lath.com/drwall/j_bead.htm; published 2005.

Amico Product Sheet; "Vinyl>Stucco>Casing Bead (Regular Ground)"; 1 page; http://www.amico-lath.com/stucco/casing_bead_regular.htm; published 2005.

Amico Product Sheet; "Vinyl>Stucco>"J" Metal Bead"; 1 page; http://www.amico-lath.com/lath/j-metal-bead.htm; published 2005.

Amico Product Sheet; "Stucco Corner Beads"; 20 pages; www.amico-vinyl.com.: downloaded Sep. 28, 2010.

Amico Product Sheet; "Vinyl>Stucco>One-Coat Casing Bead"; 1 page; http://www.amico-lath.com/stucco/one_coat_casing_bead.htm; published 2005.

U.S. Appl. No. 13/291,563, filed Nov. 8, 2011.

Office Action mailed Apr. 16, 2013 for U.S. Appl. No. 13/291,563.

Office Action mailed Jul. 2, 2013 for U.S. Appl. No. 13/291,563.

Office Action mailed Jun. 13, 2012 for U.S. Appl. No. 29/416,699 now abandoned.

Notice of Allowance mailed Nov. 7, 2011 for U.S. Appl. No. 29/400,920, filed Sep. 2, 2011.

International Search Report, Form PCT/ISA/210 for PCT International Patent Application No. PCT/EP2013/066049, mailing date Oct. 24, 2013.

Written Opinion, Form PCT/ISA/237 for PCT International Patent Application No. PCT/EP2013/066049, mailing date Oct. 24, 2013.

* cited by examiner

TRIM BEAD AND STUCCO SYSTEM INCLUDING SAME

CROSS REFERENCE TO RELATED APPLICATIONS

This application is a continuation of U.S. Ser. No. 13/572,217 filed on Aug. 10, 2012, which is a continuation-in-part application of U.S. Ser. No. 13/291,563 filed on Nov. 8, 2011, now abandoned, which claims the benefit of the filing date of U.S. Provisional Application Patent Ser. No. 61/411,125 filed Nov. 8, 2010, all of which are hereby incorporated by reference.

BACKGROUND

Exterior stucco or cement plaster, as it is commonly known, is installed on commercial as well as residential buildings and can be applied over a variety of substrates such as masonry as well as framed/sheathed wall assemblies. Depending upon the type of substrate, an intervening layer of a water resistive barrier and lath or plaster base, which serves as a mechanical key for the stucco, is applied prior to the application of the stucco.

There are two common types of stucco which are commonly referred to as One Coat Stucco which generally consists of a ⅜ to ½ inch thick stucco and Three Coat or traditional stucco which generally consists of ½ to ¾ inch thick stucco. The stucco is either hand troweled or spray applied to the substrate or lath (if used). Trim accessories, also known in the building and construction industry as trim bead, which are fabricated from metal or plastic, are used in conjunction with stucco to serve as a gauge for the stucco thickness and/or as a termination or stopping point for the stucco. A finish coat or paint/coating is applied over the dry/cured stucco to provide the final appearance.

Thermal insulation, when used with stucco clad walls, is most commonly achieved by installing one of several types in the stud or wall cavity. In some cases, limited thicknesses (generally no greater than 1½") of a thermal insulation board, which is generally a foam plastic such as Expanded Polystyrene, is installed continuously over the substrate prior to the application of the lath. Historically, continuous thermal insulation board has been used more often with the One Coat Stucco systems than with Three Coat Stucco systems.

Due to recent energy codes such as the IECC (International Energy Conservation Code), as well as standards such as ASHRAE (American Society of Heating, Refrigerating, and Air-Conditioning Engineers), there is an increasing demand in many cases to use Stucco with continuous thermal insulation applied over the substrate at greater thicknesses than the 1½" which has traditionally been used in the past. In fact, continuous insulation thicknesses of 4" or more may be needed to satisfy existing or anticipated energy code requirements. As the thickness of the continuous insulation board increases, it can change the geometry, profile, complexity and detailing of stucco wall assemblies specifically as it relates to satisfying conditions such as fire requirements, drainage, and final aesthetic appearance. Trim accessories, originally intended for use with stucco that did not contain continuous insulation or possibly accommodated thinner (1½" thick or less) continuously insulated systems often can not accommodate the thicker continuously insulated systems. Current commercially available trim accessories, which for various technical as well as aesthetic reasons, do not sufficiently satisfy the thicker continuous insulation systems. As a result, there is a need to develop a new type of trim accessory that will better accommodate continuously insulated stucco systems.

DETAILED DESCRIPTION

Figure 1:
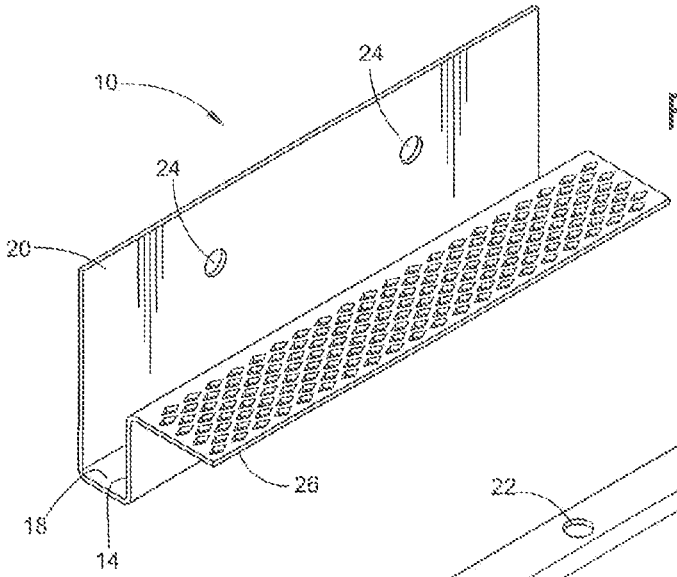
FIG. 1 is a top perspective view of one illustrative embodiment of the trim bead.

Provided is a trim bead, which can be fabricated from various materials, that will address the unique needs of stucco systems that incorporate various thicknesses of continuous, thermal exterior insulation. The trim bead will enable the continuous insulation to be sufficiently encapsulated with stucco, provide a means to drain incidental moisture as would be needed at heads, foundation, as well as other similar conditions and openings, provides a mechanical key for the stucco, a ground or thickness gauge, and is aesthetically pleasing since it enables more of the stucco (and less of the trim bead) to be visible. If necessary, depending upon the type and requirements of the construction, encapsulation of the continuous thermal insulation by the stucco can provide fire protection.

The trim bead is for use in an exterior building wall. The trim bead comprises spaced-apart front and rear walls, a bottom wall extending between and connecting the front and rear walls, and a flange portion extending substantially horizontally from the front wall. The flange of the trim accessory includes a plurality of openings communicating through the thickness of the flange.

According to certain embodiments, the trim bead comprises spaced-apart front and rear walls, a bottom wall extending between and connecting the front and rear walls, and a flange portion extending substantially horizontally from the front wall. The flange of the trim accessory includes a plurality of openings communicating through the thickness of the flange. The trim bead also includes a beak portion or protrusion projecting beyond the front wall of the trim bead.

According to certain illustrative embodiments, the trim bead comprises spaced-apart front and rear walls, a bottom wall extending between and connecting the front and rear walls, and a flange portion extending substantially horizontally from the front wall. According to this embodiment, the bottom wall extends outwardly from the front wall of the trim bead to form a horizontal protrusion. A second protrusion extends outwardly from the front wall and is positioned in a spaced-apart relationship between the bottom wall and the horizontally extending flange portion of the trim bead. The bottom wall protrusion and spaced-apart second protrusion extend substantially parallel to each other along the length of the longitudinal axis of the trim bead. The horizontal flange of the trim accessory includes a plurality of openings communicating through the thickness of the flange.

According to further illustrative embodiments, the trim bead comprises spaced-apart front and rear walls, a bottom wall extending between and connecting the front and rear walls, and a flange portion extending substantially horizontally from the front wall. According to this embodiment, the bottom wall of the trim bead extends beyond the front wall of the trim bead and includes an inclined wall portion extending toward and terminating at the front wall. That is, the included wall portion extends upwardly and backwardly toward the front wall of the trim bead. The horizontal flange of the trim accessory includes a plurality of openings communicating through the thickness of the flange.

The trim bead may comprise a polymer material, a metal material, a metal alloy material, or a composite material.

According to certain embodiments, the bottom wall comprises at least one weep hole to drain water and other incidental moisture from the wall to the external environment. The rear wall may comprise at least one opening communicating at least partially through the thickness of the rear wall to engage a mechanical fastener to fasten the trim bead to the building wall substrate. In the event that the trim bead is utilized is a jamb area of an opening in the building structure, it does not require a weep hole for drainage purposes.

The flange is provided with a plurality of openings communicating through the thickness of the flange to hold an exterior finishing material, such as stucco. The openings may be formed in metal or metal alloy flanges by perforating, stamping, or expanding the material of the flange of the trim bead. According to alternative embodiments, the trim bead may be made from a polymer material and the openings may be formed in the polymer material. The openings allow the exterior finishing material, such as stucco, to communicate through the thickness of the flange. In the construction industry, the term "keying" is used to describe an exterior finishing material communicating through an opening in an object.

In certain embodiments, the flange may comprise a mesh, a diamond mesh, or a ribbed structure.

Also provided is an exterior finish system for building walls. The exterior finish system comprises optionally a weather resistive barrier, a trim bead, an insulation layer, a reinforcement layer for exterior finish materials, and at least one layer of an exterior finishing coating applied to the reinforcement layer and the flange of the trim bead. The trim bead comprises spaced-apart front and rear walls, a bottom wall connecting the front and rear walls, and a flange portion extending from the front wall.

According to certain embodiments, the exterior finish system comprises optionally a weather resistive barrier, a trim bead, an insulation layer, a reinforcement layer for exterior finish materials, and at least one layer of an exterior finishing coating applied to the reinforcement layer and the flange of the trim bead. The trim bead comprises spaced-apart front and rear walls, a bottom wall extending between and connecting the front and rear walls, and a flange portion extending substantially horizontally from the front wall. According to this embodiment, the bottom wall extends outwardly from the front wall of the trim bead to form a horizontal protrusion. A second protrusion extends outwardly from the front wall and is positioned in a spaced-apart relationship between the bottom wall and the horizontally extending flange portion of the trim bead. The bottom wall protrusion and spaced-apart second protrusion extend substantially parallel to each other along the length of the longitudinal axis of the trim bead. The horizontal flange of the trim accessory includes a plurality of openings communicating through the thickness of the flange.

According to other illustrative embodiments, the exterior finish system comprises optionally a weather resistive barrier, a trim bead, an insulation layer, a reinforcement layer for exterior finish materials, and at least one layer of an exterior finishing coating applied to the reinforcement layer and the flange of the trim bead. The trim bead comprises spaced-apart front and rear walls, a bottom wall extending between and connecting the front and rear walls, and a flange portion extending substantially horizontally from the front wall. According to this embodiment, the bottom wall of the trim bead extends beyond the front wall of the trim bead and includes an inclined wall portion extending toward and terminating at the front wall, thereby forming a beak portion or protrusion.

Also provided is a stucco system for building walls. The stucco finish system comprises optionally a weather resistive barrier, a trim bead, an insulation layer, a lath attached to the insulation layer, and at least one layer of a stucco coating applied to the lath, the insulation layer, and to the flange of the trim bead. The trim bead comprises spaced-apart front and rear walls, a bottom wall connecting the front and rear walls, and a flange portion extending from the front wall.

According to certain illustrative embodiments, the stucco finish system comprises optionally a weather resistive barrier, a trim bead, an insulation layer, a lath attached to the insulation layer, and at least one layer of a stucco coating applied to the lath, the insulation layer, and to the flange of the trim bead. The trim bead comprises spaced-apart front and rear walls, a bottom wall extending between and connecting the front and rear walls, and a flange portion extending substantially horizontally from the front wall. According to this embodiment, the bottom wall extends outwardly from the front wall of the trim bead to form a horizontal protrusion. A second protrusion extends outwardly from the front wall and is positioned in a spaced-apart relationship between the bottom wall and the horizontally extending flange portion of the trim bead. The bottom wall protrusion and spaced-apart second protrusion extend substantially parallel to each other along the length of the longitudinal axis of the trim bead. The horizontal flange of the trim accessory includes a plurality of opening communicating through the thickness of the flange.

According to other illustrative embodiments, the stucco finish system comprises optionally a weather resistive barrier, a trim bead, an insulation layer, a lath attached to the insulation layer, and at least one layer of a stucco coating applied to the lath, the insulation layer, and to the flange of the trim bead. The trim bead comprises spaced-apart front and rear walls, a bottom wall extending between and connecting the front and rear walls, and a flange portion extending substantially horizontally from the front wall. According to this embodiment, the bottom wall of the trim bead extends beyond the front wall of the trim bead and includes an inclined wall portion extending toward and terminating at the front wall.

An exterior building wall is also provided. The exterior building wall comprises a frame having an exterior surface. A trim bead is attached to the exterior surfaces of the frame. A weather resistive barrier is optionally attached to said exterior surface of said frame, prior to the trim bead. The trim bead comprises spaced-apart front and rear walls, a bottom wall connecting the front and rear walls, and a flange portion extending from the front wall. The flange of the trim bead includes a plurality of openings communicating through the thickness of the flange. An insulation layer is adjacent the trim bead and attached the frame, a reinforcement layer attached to the insulation layer, and at least one layer of an exterior finishing coating is applied to the insulation layer and the flange of the trim bead.

The exterior building wall comprises a frame having an exterior surface. A trim bead is attached to the exterior surfaces of the frame. A weather resistive barrier is optionally attached to said exterior surface of said frame, prior to the trim bead. The trim bead comprises spaced-apart front and rear walls, a bottom wall extending between and connecting the front and rear walls, and a flange portion extending substantially horizontally from the front wall. According to this embodiment, the bottom wall extends outwardly from the front wall of the trim bead to form a horizontal protrusion. A second protrusion extends outwardly from the front wall and is positioned in a spaced-apart relationship between the bottom wall and the horizontally extending flange portion of the trim bead. The bottom wall protrusion and spaced-apart second protrusion extend substantially parallel to each other along the length of the longitudinal axis of the trim bead. An insulation layer is adjacent the trim bead and attached the frame, a reinforcement layer attached to the insulation layer, and at least one layer of an exterior finishing coating is applied to the insulation layer and the flange of the trim bead.

The exterior building wall comprises a frame having an exterior surface. A trim bead is attached to the exterior surfaces of the frame. A weather resistive barrier is optionally attached to said exterior surface of said frame, prior to the trim bead. The trim bead comprises spaced-apart front and rear walls, a bottom wall extending between and connecting the front and rear walls, and a flange portion extending substantially horizontally from the front wall. According to this embodiment, the bottom wall of the trim bead extends beyond the front wall of the trim bead and includes an inclined wall portion extending toward and terminating at the front wall. An insulation layer is adjacent the trim bead and attached the frame, a reinforcement layer attached to the insulation layer, and at least one layer of an exterior finishing coating is applied to the insulation layer and the flange of the trim bead.

According to certain illustrative embodiments, the exterior building wall comprises a frame having an exterior surface. A trim bead is attached to the exterior surfaces of the frame. The trim bead comprises spaced-apart front and rear walls, a bottom wall connecting the front and rear walls, and a flange portion extending from the front wall. The flange of the trim accessory includes a plurality of opening communicating through the thickness of the flange. An insulation layer is adjacent the trim bead and attaches from the building wall, a lath is attached over the insulation layer, and at least one layer of a stucco coating is applied to the insulation layer and the flange of the trim bead.

According to certain illustrative embodiments, the exterior building wall comprises a frame having an exterior surface. A trim bead is attached to the exterior surfaces of the frame. The trim bead comprises spaced-apart front and rear walls, a bottom wall extending between and connecting the front and rear walls, and a flange portion extending substantially horizontally from the front wall. According to this embodiment, the bottom wall extends outwardly from the front wall of the trim bead to form a horizontal protrusion. A second protrusion extends outwardly from the front wall and is positioned in a spaced-apart relationship between the bottom wall and the horizontally extending flange portion of the trim bead. The bottom wall protrusion and spaced-apart second protrusion extend substantially parallel to each other along the length of the longitudinal axis of the trim bead. An insulation layer is adjacent the trim bead and attaches from the building wall, a lath is attached over the insulation layer, and at least one layer of a stucco coating is applied to the insulation layer and the flange of the trim bead.

According to certain illustrative embodiments, the exterior building wall comprises a frame having an exterior surface. A trim bead is attached to the exterior surfaces of the frame. The trim bead comprises spaced-apart front and rear walls, a bottom wall extending between and connecting the front and rear walls, and a flange portion extending substantially horizontally from the front wall. According to this embodiment, the bottom wall of the trim bead extends beyond the front wall of the trim bead and includes an inclined wall portion extending toward and terminating at the front wall. An insulation layer is adjacent the trim bead and attaches from the building wall, a lath is attached over the insulation layer, and at least one layer of a stucco coating is applied to the insulation layer and the flange of the trim bead.

According to certain illustrative embodiments, the exterior building wall comprises a frame having an exterior surface. A building wall substrate is attached to the exterior surface of the frame. A trim bead is attached to the exterior surfaces of building wall substrate. The trim bead comprises spaced-apart front and rear walls, a bottom wall connecting the front and rear walls, and a flange portion extending from the front wall. The flange of the trim bead includes a plurality of opening communicating through the thickness of the flange. An insulation layer is attached to the building wall substrate, a reinforcement layer is attached to the insulation, and at least one layer of an exterior finishing coating is applied to the reinforcement layer, the insulation layer, and the flange of the trim bead.

According to certain illustrative embodiments, the exterior building wall comprises a frame having an exterior surface. A building wall substrate is attached to the exterior surface of the frame. A trim bead is attached to the exterior surfaces of building wall substrate. The trim bead comprises spaced-apart front and rear walls, a bottom wall extending between and connecting the front and rear walls, and a flange portion extending substantially horizontally from the front wall. According to this embodiment, the bottom wall extends outwardly from the front wall of the trim bead to form a horizontal protrusion. A second protrusion extends outwardly from the front wall and is positioned in a spaced-apart relationship between the bottom wall and the horizontally extending flange portion of the trim bead. The bottom wall protrusion and spaced-apart second protrusion extend substantially parallel to each other along the length of the longitudinal axis of the trim bead. An insulation layer is attached to the building wall substrate, a reinforcement layer is attached to the insulation, and at least one layer of an exterior finishing coating is applied to the reinforcement layer, the insulation layer, and the flange of the trim bead.

According to certain illustrative embodiments, the exterior building wall comprises a frame having an exterior surface. A building wall substrate is attached to the exterior surface of the frame. A trim bead is attached to the exterior surfaces of building wall substrate. According to this embodiment, the bottom wall of the trim bead extends beyond the front wall of the trim bead and includes an inclined wall portion extending toward and terminating at the front wall. An insulation layer is attached to the building wall substrate, a reinforcement layer is attached to the insulation, and at least one layer of an exterior finishing coating is applied to the reinforcement layer, the insulation layer, and the flange of the trim bead.

According to certain illustrative embodiments, the exterior building wall comprises a frame having an exterior surface. A building wall substrate is attached to the exterior surface of the frame. A trim bead is attached to the exterior surfaces of building wall substrate. The trim bead comprises spaced-apart front and rear walls, a bottom wall connecting the front and rear walls, and a flange portion extending from the front wall. The flange of the trim bead includes a plurality of opening communicating through the thickness of the flange. An insulation layer is attached to the building wall substrate, a lath is attached to the insulation layer, and at least one layer of a stucco coating is applied to the lath, the insulation layer, and flange of the trim bead.

According to certain illustrative embodiments, the exterior building wall comprises a frame having an exterior surface. A building wall substrate is attached to the exterior surface of the frame. A trim bead is attached to the exterior surfaces of building wall substrate. The trim bead comprises spaced-apart front and rear walls, a bottom wall extending between and connecting the front and rear walls, and a flange portion extending substantially horizontally from the front wall. According to this embodiment, the bottom wall extends outwardly from the front wall of the trim bead to form a horizontal protrusion. A second protrusion extends outwardly from the front wall and is positioned in a spaced-apart relationship between the bottom wall and the horizontally extending flange portion of the trim bead. The bottom wall protrusion and spaced-apart second protrusion extend substantially parallel to each other along the length of the longitudinal axis of the trim bead. An insulation layer is attached to the building wall substrate, a lath is attached to the insulation layer, and at least one layer of a stucco coating is applied to the lath, the insulation layer, and flange of the trim bead.

According to certain illustrative embodiments, the exterior building wall comprises a frame having an exterior surface. A building wall substrate is attached to the exterior surface of the frame. A trim bead is attached to the exterior surfaces of building wall substrate. According to this embodiment, the bottom wall of the trim bead extends beyond the front wall of the trim bead and includes an inclined wall portion extending toward and terminating at the front wall. An insulation layer is attached to the building wall substrate, a lath is attached to the insulation layer, and at least one layer of a stucco coating is applied to the lath, the insulation layer, and flange of the trim bead.

According to further illustrative embodiments, the exterior building wall comprises a frame having an exterior surface. A building wall substrate is attached to the exterior surface of the frame. A weather resistive barrier is attached over the building wall substrate. A trim bead is attached to the exterior surfaces of building wall substrate. The weather resistive barrier overlays the vertical rear wall of the trim bead that is positioned adjacent the exteriorly facing surface of the building wall substrate. The trim bead comprises spaced-apart front and rear walls, a bottom wall connecting the front and rear walls, and a flange portion extending from the front wall. The flange of the trim bead includes a plurality of openings communicating through the thickness of the flange. An insulation layer is adjacent the trim bead, and attaches to the building wall substrate. A reinforcement layer is attached to the insulation layer. At least one layer of an exterior finishing coating is applied to a reinforcement layer or the insulation layer and the flange of the trim bead.

According to further illustrative embodiments, the exterior building wall comprises a frame having an exterior surface. A building wall substrate is attached to the exterior surface of the frame. A weather resistive barrier is attached over the building wall substrate. A trim bead is attached to the exterior surfaces of building wall substrate. The weather resistive barrier overlays the vertical rear wall of the trim bead that is positioned adjacent the exteriorly facing surface of the building wall substrate. The trim bead comprises spaced-apart front and rear walls, a bottom wall extending between and connecting the front and rear walls, and a flange portion extending substantially horizontally from the front wall. According to this embodiment, the bottom wall extends outwardly from the front wall of the trim bead to form a horizontal protrusion. A second protrusion extends outwardly from the front wall and is positioned in a spaced-apart relationship between the bottom wall and the horizontally extending flange portion of the trim bead. The bottom wall protrusion and spaced-apart second protrusion extend substantially parallel to each other along the length of the longitudinal axis of the trim bead. An insulation layer is adjacent the trim bead, and attaches to the building wall substrate. A reinforcement layer is attached to the insulation layer. At least one layer of an exterior finishing coating is applied to a reinforcement layer or the insulation layer and the flange of the trim bead.

According to further illustrative embodiments, the exterior building wall comprises a frame having an exterior surface. A building wall substrate is attached to the exterior surface of the frame. A weather resistive barrier is attached over the building wall substrate. A trim bead is attached to the exterior surfaces of building wall substrate. The weather resistive barrier overlays the vertical rear wall of the trim bead that is positioned adjacent the exteriorly facing surface of the building wall substrate. According to this embodiment, the bottom wall of the trim bead extends beyond the front wall of the trim bead and includes an inclined wall portion extending toward and terminating at the front wall. An insulation layer is adjacent the trim bead, and attaches to the building wall substrate. A reinforcement layer is attached to the insulation layer. At least one layer of an exterior finishing coating is applied to a reinforcement layer or the insulation layer and the flange of the trim bead.

According to further illustrative embodiments, the exterior building wall comprises a frame having an exterior surface. A building wall substrate is attached to the exterior surface of the frame. A weather resistive barrier is attached over the building wall substrate. A trim bead is attached to the exterior surfaces of building wall substrate. The weather barrier overlays the vertical rear wall of the trim bead that is positioned adjacent the exteriorly facing surface of the building wall substrate. The trim bead comprises spaced-apart front and rear walls, a bottom wall connecting the front and rear walls, and a flange portion extending from the front wall. The flange of the trim accessory includes a plurality of opening communicating through the thickness of the flange. An insulation layer is adjacent said trim bead and attached to the building wall substrate, a lath is attached to the insulation layer, and at least one layer of a stucco coating is applied to the insulation layer and the flange of the trim bead.

According to further illustrative embodiments, the exterior building wall comprises a frame having an exterior surface. A building wall substrate is attached to the exterior surface of the frame. A weather resistive barrier is attached over the building wall substrate. A trim bead is attached to the exterior surfaces of building wall substrate. The weather barrier overlays the vertical rear wall of the trim bead that is positioned adjacent the exteriorly facing surface of the building wall substrate. The trim bead comprises spaced-apart front and rear walls, a bottom wall extending between and connecting the front and rear walls, and a flange portion extending substantially horizontally from the front wall. According to this embodiment, the bottom wall extends outwardly from the front wall of the trim bead to form a horizontal protrusion. A second protrusion extends outwardly from the front wall and is positioned in a spaced-apart relationship between the bottom wall and the horizontally extending flange portion of the trim bead. The bottom wall protrusion and spaced-apart second protrusion extend substantially parallel to each other along the length of the longitudinal axis of the trim bead. An insulation layer is adjacent said trim bead and attached to the building wall substrate, a lath is attached to the insulation layer, and at least one layer of a stucco coating is applied to the insulation layer and the flange of the trim bead.

According to further illustrative embodiments, the exterior building wall comprises a frame having an exterior surface. A building wall substrate is attached to the exterior surface of the frame. A weather resistive barrier is attached over the building wall substrate. A trim bead is attached to the exterior surfaces of building wall substrate. The weather barrier overlays the vertical rear wall of the trim bead that is positioned adjacent the exteriorly facing surface of the building wall substrate. According to this embodiment, the bottom wall of the trim bead extends beyond the front wall of the trim bead and includes an inclined wall portion extending toward and terminating at the front wall. An insulation layer is adjacent said trim bead and attached to the building wall substrate, a lath is attached to the insulation layer, and at least one layer of a stucco coating is applied to the insulation layer and the flange of the trim bead.

A process for finishing an exterior building wall is also provided. The process for finishing an exterior building wall comprises attaching a trim bead to the exterior surfaces of a framed wall. The trim bead comprises spaced-apart front and rear walls, a bottom wall connecting the front and rear walls, and a flange portion extending from the front wall. The flange of the trim bead includes a plurality of opening communicating through the thickness of the flange, attaching an insulation layer to the building wall frame, and applying a layer of an exterior finishing material coating to the surfaces of the insulation layer and the flange of the trim bead.

According to certain illustrative embodiments, the process for finishing an exterior building wall comprises attaching a trim bead to the exterior surfaces of a framed wall. The trim bead comprises spaced-apart front and rear walls, a bottom wall connecting the front and rear walls, and a flange portion extending from the front wall. According to this embodiment, the bottom wall extends outwardly from the front wall of the trim bead to form a horizontal protrusion. A second protrusion extends outwardly from the front wall and is positioned in a spaced-apart relationship between the bottom wall and the horizontally extending flange portion of the trim bead. The bottom wall protrusion and spaced-apart second protrusion extend substantially parallel to each other along the length of the longitudinal axis of the trim bead. The flange of the trim bead includes a plurality of opening communicating through the thickness of the flange, attaching an insulation layer to the building wall frame, and applying a layer of an exterior finishing material coating to the surfaces of the insulation layer and the flange of the trim bead.

The process for finishing an exterior building wall comprises attaching a trim bead to the exterior surfaces of a framed wall. The trim bead comprises spaced-apart front and rear walls, a bottom wall connecting the front and rear walls, and a flange portion extending from the front wall. According to this embodiment, the bottom wall of the trim bead extends beyond the front wall of the trim bead and includes an inclined wall portion extending toward and terminating at the front wall. The flange of the trim bead includes a plurality of opening communicating through the thickness of the flange, attaching an insulation layer to the building wall frame, and applying a layer of an exterior finishing material coating to the surfaces of the insulation layer and the flange of the trim bead.

According to certain illustration embodiments, the process for finishing an exterior building wall comprises attaching a trim bead to the exterior surfaces of a framed wall. The trim bead comprises spaced-apart front and rear walls, a bottom wall connecting the front and rear walls, and a flange portion extending from the front wall. The flange of the trim bead includes a plurality of openings communicating through the thickness of the flange, attaching an insulation layer to the building wall frame, attaching a lath to the insulation, and applying a layer of a stucco coating to the surfaces of the lath, or the insulation layer and the flange of the trim bead.

According to certain illustration embodiments, the process for finishing an exterior building wall comprises attaching a trim bead to the exterior surfaces of a framed wall. The trim bead comprises spaced-apart front and rear walls, a bottom wall connecting the front and rear walls, and a flange portion extending from the front wall. According to this embodiment, the bottom wall extends outwardly from the front wall of the trim bead to form a horizontal protrusion. A second protrusion extends outwardly from the front wall and is positioned in a spaced-apart relationship between the bottom wall and the horizontally extending flange portion of the trim bead. The bottom wall protrusion and spaced-apart second protrusion extend substantially parallel to each other along the length of the longitudinal axis of the trim bead. The flange of the trim bead includes a plurality of openings communicating through the thickness of the flange, attaching an insulation layer to the building wall frame, attaching a lath to the insulation, and applying a layer of a stucco coating to the surfaces of the lath, or the insulation layer and the flange of the trim bead.

According to certain illustration embodiments, the process for finishing an exterior building wall comprises attaching a trim bead to the exterior surfaces of a framed wall. The trim bead comprises spaced-apart front and rear walls, a bottom wall connecting the front and rear walls, and a flange portion extending from the front wall. According to this embodiment, the bottom wall of the trim bead extends beyond the front wall of the trim bead and includes an inclined wall portion extending toward and terminating at the front wall. The flange of the trim bead includes a plurality of opening communicating through the thickness of the flange, attaching an insulation layer to the building wall frame, attaching a lath to the insulation, and applying a layer of a stucco coating to the surfaces of the lath, or the insulation layer and the flange of the trim bead.

According to further illustrative embodiments, the process for finishing an exterior building wall comprises attaching a building wall substrate to the exterior surfaces of the framed wall. A trim bead is then attached to the exterior surfaces of the building wall substrate. The trim bead comprises spaced-apart front and rear walls, a bottom wall connecting the front and rear walls, and a flange portion extending from the front wall. The flange of the trim bead includes a plurality of openings communicating through the thickness of the flange, attaching an insulation layer to the building wall substrate, and applying a layer of an exterior finishing material coating to the surfaces of the insulation layer and the flange of the trim bead.

According to further illustrative embodiments, the process for finishing an exterior building wall comprises attaching a building wall substrate to the exterior surfaces of the framed wall. A trim bead is then attached to the exterior surfaces of the building wall substrate. The trim bead comprises spaced-apart front and rear walls, a bottom wall connecting the front and rear walls, and a flange portion extending from the front wall. According to this embodiment, the bottom wall extends outwardly from the front wall of the trim bead to form a horizontal protrusion. A second protrusion extends outwardly from the front wall and is positioned in a spaced-apart relationship between the bottom wall and the horizontally extending flange portion of the trim bead. The bottom wall protrusion and spaced-apart second protrusion extend substantially parallel to each other along the length of the longitudinal axis of the trim bead. The flange of the trim bead includes a plurality of openings communicating through the thickness of the flange, attaching an insulation layer to the building wall substrate, and applying a layer of an exterior finishing material coating to the surfaces of the insulation layer and the flange of the trim bead.

According to further illustrative embodiments, the process for finishing an exterior building wall comprises attaching a building wall substrate to the exterior surfaces of the framed wall. A trim bead is then attached to the exterior surfaces of the building wall substrate. The trim bead comprises spaced-apart front and rear walls, a bottom wall connecting the front and rear walls, and a flange portion extending from the front wall. According to this embodiment, the bottom wall of the trim bead extends beyond the front wall of the trim bead and includes an inclined wall portion extending toward and terminating at the front wall. The flange of the trim bead includes a plurality of openings communicating through the thickness of the flange, attaching an insulation layer to the building wall substrate, and applying a layer of an exterior finishing material coating to the surfaces of the insulation layer and the flange of the trim bead.

According to further illustrative embodiments, the process for finishing an exterior building wall comprises attaching a building wall substrate to the exterior surfaces of the framed wall. A trim bead is then attached to the exterior surfaces of the building wall substrate. The trim bead comprises spaced-apart front and rear walls, a bottom wall connecting the front and rear walls, and a flange portion extending from the front wall. The flange of the trim bead includes a plurality of opening communicating through the thickness of the flange, attaching an insulation layer to the building wall substrate, attaching a lath to the insulation, and applying a layer of a stucco coating to the lath which has been installed over the insulation layer and the flange of the trim bead.

According to further illustrative embodiments, the process for finishing an exterior building wall comprises attaching a building wall substrate to the exterior surfaces of the framed wall. A trim bead is then attached to the exterior surfaces of the building wall substrate. The trim bead comprises spaced-apart front and rear walls, a bottom wall connecting the front and rear walls, and a flange portion extending from the front wall. According to this embodiment, the bottom wall extends outwardly from the front wall of the trim bead to form a horizontal protrusion. A second protrusion extends outwardly from the front wall and is positioned in a spaced-apart relationship between the bottom wall and the horizontally extending flange portion of the trim bead. The bottom wall protrusion and spaced-apart second protrusion extend substantially parallel to each other along the length of the longitudinal axis of the trim bead. The flange of the trim bead includes a plurality of opening communicating through the thickness of the flange, attaching an insulation layer to the building wall substrate, attaching a lath to the insulation, and applying a layer of a stucco coating to the lath which has been installed over the insulation layer and the flange of the trim bead.

According to further illustrative embodiments, the process for finishing an exterior building wall comprises attaching a building wall substrate to the exterior surfaces of the framed wall. A trim bead is then attached to the exterior surfaces of the building wall substrate. The trim bead comprises spaced-apart front and rear walls, a bottom wall connecting the front and rear walls, and a flange portion extending from the front wall. According to this embodiment, the bottom wall of the trim bead extends beyond the front wall of the trim bead and includes an inclined wall portion extending toward and terminating at the front wall. The flange of the trim bead includes a plurality of opening communicating through the thickness of the flange, attaching an insulation layer to the building wall substrate, attaching a lath to the insulation, and applying a layer of a stucco coating to the lath which has been installed over the insulation layer and the flange of the trim bead.

According to further illustrative embodiments, the process for finishing an exterior building wall comprises attaching a building wall substrate to the exterior surfaces of the framed wall. A weather resistive barrier is attached over the building wall substrate. A trim bead is then attached to the weather resistive barrier-covered building wall substrate. The weather resistive barrier is applied over a portion of the vertical rear wall of the trim bead that is positioned adjacent the exteriorly facing surface of the building wall substrate. The trim bead comprises spaced-apart front and rear walls, a bottom wall connecting the front and rear walls, and a flange portion extending from the front wall. The flange of the trim bead includes a plurality of opening communicating through the thickness of the flange, attaching an insulation layer to the building wall substrate, and applying a layer of an exterior finishing material coating to the surfaces of the insulation layer and the flange of the trim bead.

According to further illustrative embodiments, the process for finishing an exterior building wall comprises attaching a building wall substrate to the exterior surfaces of the framed wall. A weather resistive barrier is attached over the building wall substrate. A trim bead is then attached to the weather resistive barrier-covered building wall substrate. The trim bead comprises spaced-apart front and rear walls, a bottom wall connecting the front and rear walls, and a flange portion extending from the front wall. According to this embodiment, the bottom wall extends outwardly from the front wall of the trim bead to form a horizontal protrusion. A second protrusion extends outwardly from the front wall and is positioned in a spaced-apart relationship between the bottom wall and the horizontally extending flange portion of the trim bead. The bottom wall protrusion and spaced-apart second protrusion extend substantially parallel to each other along the length of the longitudinal axis of the trim bead. The weather resistive barrier is applied over a portion of the vertical rear wall of the trim bead that is positioned adjacent the exteriorly facing surface of the building wall substrate. The flange of the trim bead includes a plurality of opening communicating through the thickness of the flange, attaching an insulation layer to the building wall substrate, and applying a layer of an exterior finishing material coating to the surfaces of the insulation layer and the flange of the trim bead.

According to further illustrative embodiments, the process for finishing an exterior building wall comprises attaching a building wall substrate to the exterior surfaces of the framed wall. A weather resistive barrier is attached over the building wall substrate. A trim bead is then attached to the weather resistive barrier-covered building wall substrate. According to this embodiment, the bottom wall of the trim bead extends beyond the front wall of the trim bead and includes an inclined wall portion extending toward and terminating at the front wall. The weather resistive barrier is applied over a portion of the vertical rear wall of the trim bead that is positioned adjacent the exteriorly facing surface of the building wall substrate. The flange of the trim bead includes a plurality of opening communicating through the thickness of the flange, attaching an insulation layer to the building wall substrate, and applying a layer of an exterior finishing material coating to the surfaces of the insulation layer and the flange of the trim bead.

According to further illustrative embodiments, the process for finishing an exterior building wall comprises attaching a building wall substrate to the exterior surfaces of the framed wall. A weather resistive barrier is attached over the building wall substrate. The weather resistive barrier is applied over at least a portion of the vertical rear wall of the trim bead that is positioned adjacent the exteriorly facing surface of the building wall substrate. A trim bead is then attached to the weather resistive barrier-covered building wall substrate. The trim bead comprises spaced-apart front and rear walls, a bottom wall connecting the front and rear walls, and a flange portion extending from the front wall. The flange of the trim bead includes a plurality of opening communicating through the thickness of the flange, attaching an insulation layer to the building wall substrate, attaching a lath to the insulation layer, and applying a layer of a stucco coating to the lath which has been installed over the insulation layer and the flange of the trim bead.

The building wall substrate, without limitation, may be selected from plywood sheathing, wafer board, particle board, oriented strand board, cement board, gypsum board, poured concrete, concrete block, and masonry block. In one embodiment, the building wall substrate is a layer of plywood sheathing. According to other embodiments, the building wall substrate may be a layer of masonry block.

According to certain embodiments, the weather resistive barriers may include water resistive barriers and other well known and industry accepted sheet materials or factory applied materials that resist the transmission of water therethrough and control the transmission of moisture vapor and air therethrough. Without limitation, examples of suitable sheet materials include SENERFLASH commercially available from BASF Corporation—Wall Systems (Jacksonville, Fla., USA).

Non-woven sheets of spun-bonded high density polyethylene fibers are commercially available from E.I. DuPont de Nemours & Co., Inc. (Wilmington, Del.) under the trademarks Tyvek® HomeWrap™, Tyvek® StuccoWrap™ and Tyvek® CommercialWrap™. The non-woven structure provides excellent resistance to water and air penetration. In addition, the non-woven structure has excellent strength and tear resistance.

Alternatively to the use of the paper or sheet materials as the secondary weather barrier, a fluid applied weather resistive barrier may be used. Without limitation, any only by way of illustration, suitable roller, spray, or trowel applied secondary water resistive barriers may include those water barrier materials commercially available from BASF Corporation—Wall Systems (Jacksonville, Fla.) under the trade designations SENERSHIELD-R, FINESTOP RA, ACROSTOP R, SONOWALL FTR, ENERSHIELD HP, ENERSHIELD I, SENERSHIELD VB, and FINESTOP VB. SENERSHIELD-R, FINESTOP RA, ACROSTOP R, SONOWALL FTR, and ENERSHIELD HP are flexible, acrylic liquid coating materials. SENERSHIELD-R, FINESTOP RA, ACROSTOP R, SONOWALL FTR, and ENERSHIELD HP provide a brush-, roller- or spray-applied continuous membrane that is suitable for direct application to a wide variety of approved building wall substrates, such as plywood sheathing, cement board, gypsum sheathing, oriented strand board, poured concrete substrates, masonry unit, and the like.

A lath is used as a plaster base for the stucco coating over the continuous thermal insulation layer or the underlying building wall substrate The lath may be manufactured from metals (such as wire lath, welded-wire lath, and expanded metal lath), metal alloys, polymeric materials, inorganic fiber materials (such as glass fibers), composite materials, and the like. According to certain illustrative embodiments, the lath used in the stucco system and building wall incorporating the stucco system comprises a woven, enhanced thickness inorganic fiber fabric commercially available from BASF Corporation—Wall Systems (Jacksonville, Fla., USA) under the trade designations PERMALATH and PERMALATH 1000, as well as expanded metal lath commercially available from Alabama Metal Industries, Inc. (Birmingham, Ala., USA).

The term stucco is intended to refer to any render material that comprises a blend of a binder material, aggregate and water that is generally used as a wall covering material for building walls. Without limitation, stucco may comprise a blend of lime, sand aggregate, and water, or a blend of Portland cement, sand aggregate, and water, or a blend of Portland cement, lime, sand aggregate, and water. The stucco material may also include reinforcing fibers to improve the properties of the hardened stucco. Stucco materials are often referred to in the building and construction industry as Portland cement-based plaster. The stucco coating may be applied to the insulation layer or building wall substrate in accordance with ASTM C926 (2006) entitled "*Standard Specification for Application of Portland Cement-Based Plaster*". ASTM C926 describes the requirements for the application of full thickness Portland cement-based plaster materials for exterior and interior building walls. A wide variety of stucco base coats and finish coats are commercially available from BASF Corporation—Wall Systems (Jacksonville, Fla., USA).

An illustrative embodiment of the stucco system will now be described in greater detail with reference to the FIGURES. It should be noted that the stucco system is not intended to be limited to the illustrative embodiments shown in the FIGURES.

Figure 2:
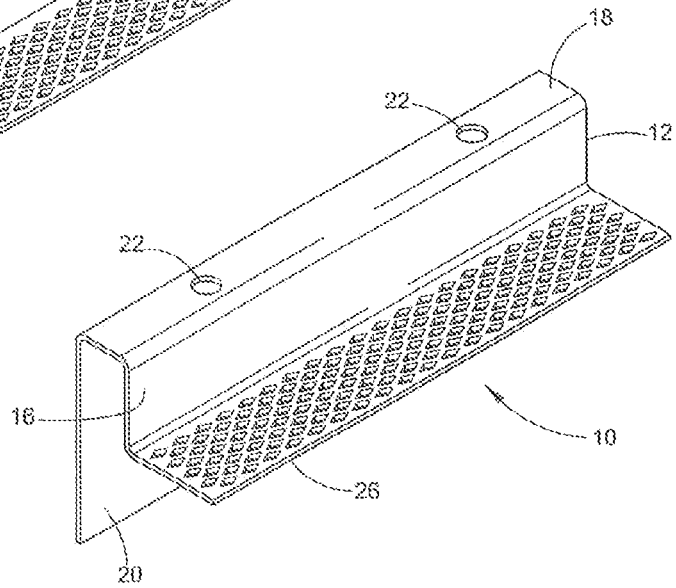
FIG. 2 is a bottom perspective view of the illustrative embodiment of the trim bead shown in FIG. 1.
Figure 3:
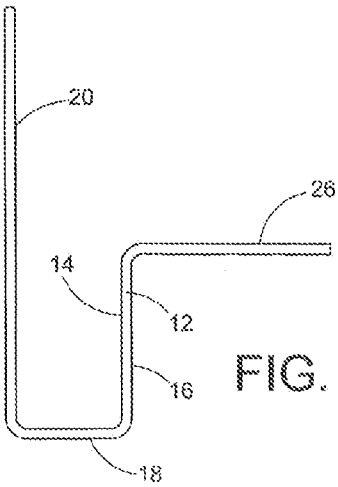
FIG. 3 is an end view of one illustrative embodiment of the trim bead.

FIGS. 1-3 show an illustrative embodiment of the trim bead 10. Trim bead includes front wall 12 having opposite facing surfaces 14, 16. Bottom wall 18 of the trim bead 10 extends outwardly surface 14 of the lower portion of front wall 12. The vertical height between bottom wall 18 and flange 26 is commonly referred to in the construction industry as the ground. Rear wall 20 extends upwardly from bottom wall 18 of trim bead 10. Rear wall 20 extends upwardly from bottom wall 18 to a height that is greater than the height of front wall 12 of the trim bead 10. While not intending to be bound to any particular geometry or shape, the illustrative embodiment of the front, bottom and rear walls create a substantially J-shaped trim bead 10.

Still referring to FIGS. 1-3, bottom wall 18 of the trim bead 10 includes one or more openings 22 that communicate through the entire thickness of bottom wall 18. These openings 22 are commonly referred to in the construction industry as weep holes and are used to drain incidental water from the wall to the external environment. Rear wall 20 may include one or more openings 24 that communicate through the entire thickness of the rear wall 20 to accommodate mechanical fasteners to secure the trim bead to the exterior surfaces of a framed wall or to the exterior surfaces of the building wall substrate layer that is attached to the building wall frame. The rear wall 20 is commonly referred to in the construction industry as the mounting or back flange.

Figure 4:
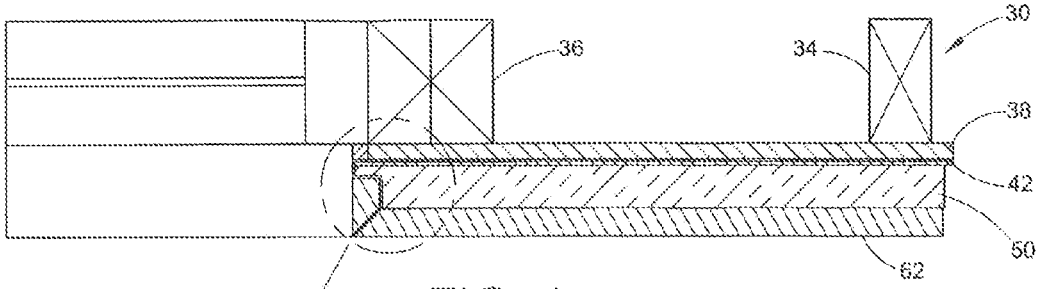
FIG. 4 is end view of one illustrative embodiment of a building wall using the trim bead shown in FIGS. 1-3.
Figure 5:
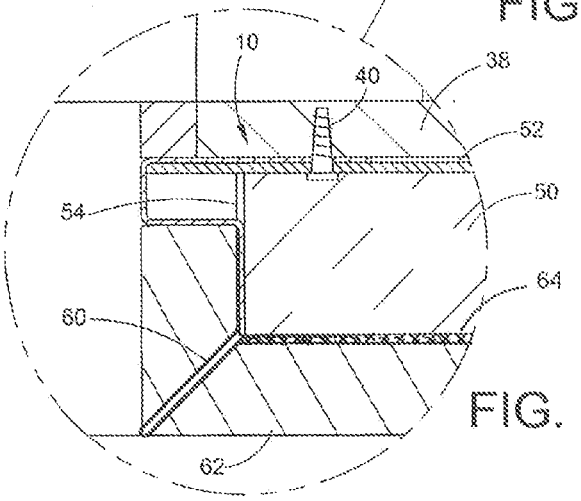
FIG. 5 is an enlarged fragmentary view of the building wall and trim bead shown in FIG. 4.

Turning to FIGS. 4 and 5, building wall 30 includes framing members 34, 36. Attached to framing member 36 is a layer of building wall sheathing 38. Trim bead 10 is attached to the exteriorly facing surface of building wall sheathing 38 with mechanical fastener 40. A weather resistive barrier 42 is applied over the exteriorly facing surface of the building wall sheathing 38. The weather barrier 42 overlaps at least a portion of the rear wall 20 of the trim bead 10. A layer of continuous thermal insulation board 50 is engaged with the trim bead 10. The rear surface 52 of the insulation board is positioned substantially adjacent to the weather resistive barrier 42. The lower surface 54 of the insulation layer is supported by the flange 26.

Referring to FIG. 5, a corner bead 60 is often used and engaged with the flange 26 of the trim bead 10. At least one layer of stucco 62 is applied over the lath 64 and continuous thermal insulation layer 50. Because the flange 24 and corner bead 60 provide mechanical keying for the stucco layer 62, the stucco layer is able to surround the thermal insulation layer 50, including the exposed lower edge 54 of the thermal insulation layer 50. In the event of industry standard fire testing (National Fire Protection Association or NFPA 285) where fire emanates from the windows of the building and upwardly along the exterior surface of the building wall 30, the use of the flange 26 and corner bead 60 permits the stucco layer 62 to protect the thermal insulation layer 50, which is typically a rigid expanded polystyrene insulation board.

Figure 6:
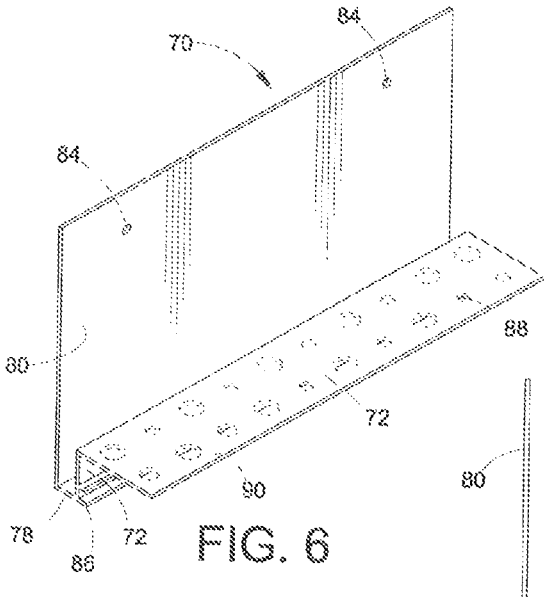
FIG. 6 is a top perspective view of one illustrative embodiment of the trim bead.
Figure 7:
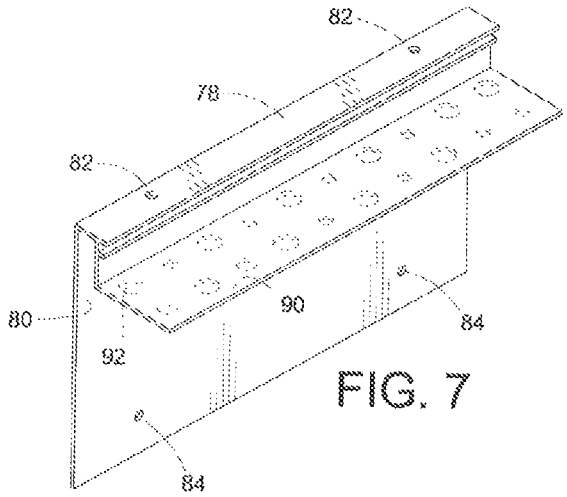
FIG. 7 is a bottom perspective view of the illustrative embodiment of the trim bead shown in FIG. 6.
Figure 8:
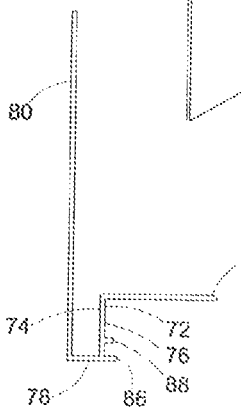
FIG. 8 is a cross sectional view of one illustrative embodiment of a building wall using the trim bead shown in FIGS. 6-7.

FIGS. 6-8 show an illustrative embodiment of the trim bead 70. Trim bead includes front wall 72 having opposite facing surfaces 74, 76. Bottom wall 78 of the trim bead 70 extends outwardly from the surface 74 of the lower portion of front wall 72. Rear wall 80 extends upwardly from bottom wall 78 of trim bead 70. Rear wall 80 extends upwardly from bottom wall 78 to a height that is greater than the height of front wall 72 of the trim bead 70.

Still referring to FIGS. 6-8, bottom wall 78 of the trim bead 70 includes one or more openings 82 that communicate through the entire thickness of bottom wall 78. These openings 82 are commonly referred to in the construction industry as weep holes and are used to drain incidental water from the wall to the external environment. Rear wall 80 may include one or more openings 84 that communicate through the entire thickness of the rear wall 80 to accommodate mechanical fasteners to secure the trim bead to the exterior surfaces of a framed wall or to the exterior surfaces of the building wall substrate layer that is attached to the building wall frame. The rear wall 80 is commonly referred to in the construction industry as the mounting or back flange.

Still referring to FIG. 6-8, a portion of the bottom wall 78 extends outwardly from the front wall 72 of the trim bead to form a horizontal protrusion 86. A second protrusion 88 extends outwardly from the front wall 72 and is positioned in a spaced-apart relationship between the bottom wall 78 and the horizontally extending flange portion 90 of the trim bead 70. The bottom wall protrusion 86 and spaced-apart second protrusion 88 extend substantially parallel to each other along the length of the longitudinal axis of the trim bead 70. The horizontal flange 90 of the trim accessory includes a plurality of openings 92 communicating through the thickness of the flange 90.

Figure 9:
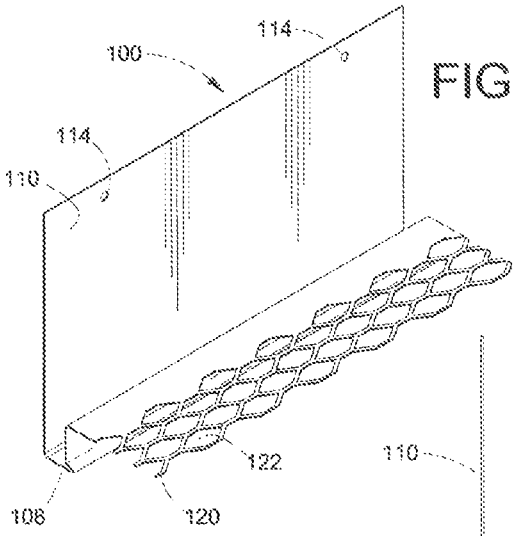
FIG. 9 is a top perspective view of one illustrative embodiment of the trim bead.
Figure 10:
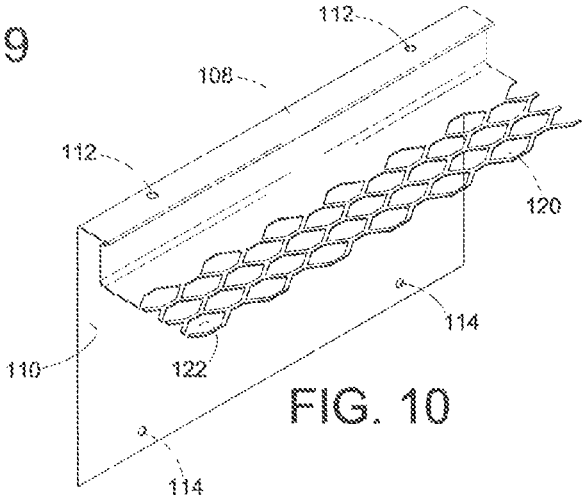
FIG. 10 is a bottom perspective view of the illustrative embodiment of the trim bead shown in FIG. 9.
Figure 11:
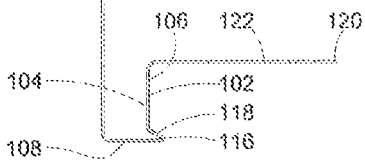
FIG. 11 is a cross sectional view of one illustrative embodiment of a building wall using the trim bead shown in FIGS. 9-10.

FIGS. 9-11 show an illustrative embodiment of the trim bead 100. Trim bead 100 includes front wall 102 having opposite facing surfaces 104, 106. Bottom wall 108 of the trim bead 100 extends outwardly from the surface of the lower portion of front wall 102. Rear wall 110 extends upwardly from bottom wall 108 of trim bead 100. Rear wall 110 extends upwardly from bottom wall 108 to a height that is greater than the height of front wall 102 of the trim bead 100.

Still referring to FIGS. 9-11, bottom wall 108 of the trim bead 100 includes one or more openings 112 that communicate through the entire thickness of bottom wall 108. These openings 112 are commonly referred to in the construction industry as weep holes and are used to drain incidental water from the wall to the external environment. Rear wall 110 may include one or more openings 114 that communicate through the entire thickness of the rear wall 110 to accommodate mechanical fasteners to secure the trim bead to the exterior surfaces of a framed wall or to the exterior surfaces of the building wall substrate layer that is attached to the building wall frame. The rear wall 100 is commonly referred to in the construction industry as the mounting or back flange.

Still referring to FIG. 9-11, a portion of the bottom wall 108 extends outwardly from the front wall 102 of the trim bead to form a horizontal protrusion 116. An inclined wall portion 118 extends toward and terminates at the front wall 102. The bottom wall protrusion 116 and inclined wall portion 118 extend substantially parallel to each other along the length of the longitudinal axis of the trim bead 100. The horizontal flange 120 of the trim accessory includes a plurality of openings 122 communicating through the thickness of the flange 120.

Figure 12:
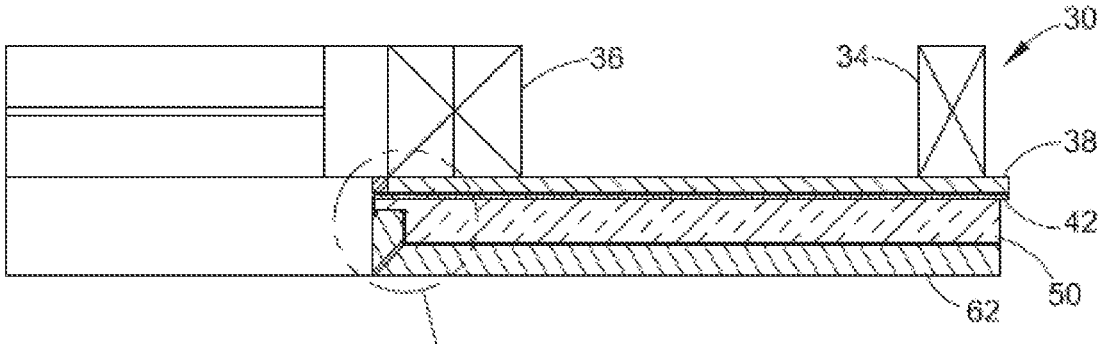
FIG. 12 is an end view of one illustrative embodiment of a building wall using the trim bead shown in FIGS. 9-11.
Figure 13:
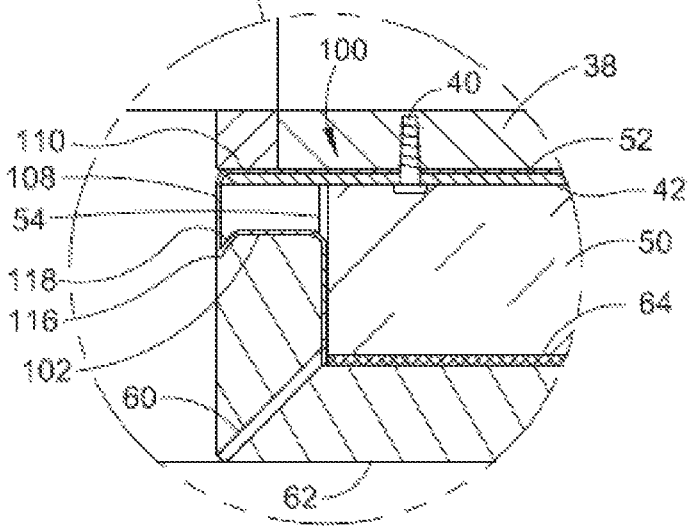
FIG. 13 is an enlarged fragmentary view of the building wall and trim bead shown in FIG. 12.

Turning to FIGS. 12 and 13, building wall 30 includes framing members 34, 36. Attached to framing member 36 is a layer of building wall sheathing 38. Trim bead 100 is attached to the exteriorly facing surface of building wall sheathing 38 with mechanical fastener 40. A weather resistive barrier 42 is applied over the exteriorly facing surface of the building wall sheathing 38. The weather barrier 42 overlaps at least a portion of the rear wall 20 of the trim bead 100. A layer of continuous thermal insulation board 50 is engaged with the trim bead 100. The rear surface 52 of the insulation board is positioned substantially adjacent to the weather resistive barrier 42. The lower surface 54 of the insulation layer is supported by the flange 26.

Referring to FIG. 13, trim bead 100 includes front wall 102, bottom wall 108 and rear wall 110. A portion of the bottom wall 108 extends outwardly from the front wall 102 of the trim bead to form a horizontal protrusion 116. An inclined wall portion 118 extends toward and terminates at the front wall 102. The horizontal flange extends horizontally from the top of the front wall 102. A corner bead 60 is often used and engaged with the flange of the trim bead 100. At least one layer of stucco 62 is applied over the lath 64 and continuous thermal insulation layer 50. Because the flange and corner bead 60 provide mechanical keying for the stucco layer 62, the stucco layer is able to surround the thermal insulation layer 50, including the exposed lower edge 54 of the thermal insulation layer 50. In the event of industry standard fire testing (National Fire Protection Association or NFPA 285) where fire emanates from the windows of the building and upwardly along the exterior surface of the building wall 30, the use of the flange 26 and corner bead 60 permits the stucco layer 62 to protect the thermal insulation layer 50, which is typically a rigid expanded polystyrene insulation board.

An illustrative embodiment of the exterior finishing system was tested in accordance with the guidelines set forth in NFPA 285 (National Fire Protection Association). NFPA 285 discloses the standard test method for the evaluation of fire propagation characteristics of exterior non-load-bearing wall assemblies containing combustible components. The illustrative embodiment comprised a trim bead; an exterior building wall comprised of a frame with an exterior surface; a weather resistant barrier attached to the wall; an insulation layer attached to the wall; a lath attached to the insulation layer; and a stucco coating.

Fifty-four (54) Type K, fiberglass jacketed thermocouples were installed within the wall system according to NFPA 285. The thermocouple data was monitored every fifteen (15) seconds by a 100-channel Yokogawa, Inc., Darwin Data Acquisition Unit. A commercial grade propane gas burner assembly was positioned on the vertical centerline, nine (9) inches below the top of the window opening, and on the horizontal centerline, three (3) inches from the plane of the exterior wall.

Temperature data from twenty-four (24) of the thermocouples were used to determine compliance with the NFPA 285 standard. Thermocouples 11, and 14-17 were positioned on the exterior wall surface. Thermocouples 18, 19, 28, and 31-40 were positioned within the exterior finishing system core. Thermocouples 49-54 were positioned on the second floor interior wall surface. Compliance with the NFPA standard required that thermocouples 11, and 14-17 not exceed 1000° F., thermocouples 18, 19, 28, and 31-40 not measure a temperature rise of greater than 750° F., and thermocouples 49-54 not measure a rise over 500° F. The results of the test are provided in Tables 1-3 below.

TABLE 1

| Time (min) | E119 Std Average (° F.) | Burn Room (° F.) | Pass/Fail TC#11 | Pass/Fail TC#14 | Pass/Fail TC#15 | Pass/Fail TC#16 | Pass/Fail TC#17 |
|---|---|---|---|---|---|---|---|
| 0 | 68 | 93 | 85 | 84 | 84 | 84 | 84 |
| 0.25 | 115 | 537 | 270 | 106 | 155 | 168 | 98 |
| 0.5 | 161 | 945 | 335 | 122 | 212 | 212 | 119 |
| 0.75 | 208 | 1080 | 357 | 112 | 217 | 237 | 131 |
| 1 | 254 | 1146 | 407 | 119 | 218 | 227 | 119 |
| 1.25 | 301 | 1187 | 413 | 124 | 249 | 242 | 133 |
| 1.5 | 348 | 1219 | 425 | 132 | 289 | 250 | 136 |
| 1.75 | 394 | 1233 | 421 | 111 | 242 | 246 | 137 |
| 2 | 441 | 1239 | 392 | 118 | 214 | 266 | 127 |
| 2.25 | 487 | 1244 | 430 | 123 | 224 | 258 | 154 |
| 2.5 | 534 | 1250 | 417 | 127 | 246 | 259 | 132 |
| 2.75 | 581 | 1266 | 411 | 125 | 243 | 262 | 138 |
| 3 | 627 | 1277 | 434 | 127 | 231 | 263 | 146 |
| 3.25 | 674 | 1288 | 425 | 124 | 222 | 261 | 155 |
| 3.5 | 720 | 1301 | 425 | 118 | 224 | 274 | 156 |
| 3.75 | 767 | 1319 | 447 | 131 | 251 | 283 | 138 |
| 4 | 814 | 1327 | 389 | 130 | 282 | 237 | 129 |
| 4.25 | 860 | 1359 | 426 | 140 | 229 | 257 | 156 |
| 4.5 | 907 | 1362 | 420 | 136 | 232 | 253 | 150 |
| 4.75 | 953 | 1365 | 422 | 129 | 214 | 262 | 149 |
| 5 | 1000 | 1360 | 428 | 133 | 233 | 274 | 160 |
| 5.25 | 1015 | 1363 | 518 | 132 | 252 | 319 | 163 |
| 5.5 | 1030 | 1364 | 513 | 137 | 269 | 326 | 166 |
| 5.75 | 1045 | 1373 | 499 | 167 | 267 | 306 | 145 |
| 6 | 1060 | 1366 | 525 | 154 | 271 | 326 | 150 |
| 6.25 | 1075 | 1366 | 499 | 157 | 287 | 335 | 157 |
| 6.5 | 1090 | 1367 | 522 | 157 | 284 | 333 | 157 |
| 6.75 | 1105 | 1372 | 528 | 150 | 270 | 316 | 162 |
| 7 | 1120 | 1369 | 519 | 142 | 260 | 359 | 167 |
| 7.25 | 1135 | 1371 | 525 | 147 | 246 | 339 | 162 |
| 7.5 | 1150 | 1376 | 524 | 157 | 257 | 322 | 155 |
| 7.75 | 1165 | 1386 | 538 | 149 | 290 | 327 | 156 |
| 8 | 1180 | 1382 | 533 | 173 | 302 | 331 | 160 |
| 8.25 | 1195 | 1388 | 497 | 152 | 277 | 354 | 156 |
| 8.5 | 1210 | 1389 | 519 | 149 | 274 | 334 | 161 |
| 8.75 | 1225 | 1387 | 520 | 150 | 269 | 337 | 163 |
| 9 | 1240 | 1390 | 536 | 141 | 284 | 328 | 163 |
| 9.25 | 1255 | 1392 | 535 | 146 | 278 | 360 | 167 |
| 9.5 | 1270 | 1396 | 521 | 161 | 286 | 333 | 165 |
| 9.75 | 1285 | 1401 | 531 | 157 | 294 | 347 | 163 |
| 10 | 1300 | 1397 | 533 | 157 | 271 | 354 | 168 |
| 10.25 | 1312 | 1397 | 548 | 145 | 281 | 370 | 181 |
| 10.5 | 1317 | 1405 | 565 | 152 | 293 | 364 | 167 |
| 10.75 | 1323 | 1406 | 551 | 164 | 295 | 364 | 167 |
| 11 | 1328 | 1409 | 570 | 161 | 288 | 371 | 171 |
| 11.25 | 1333 | 1396 | 568 | 151 | 307 | 362 | 165 |
| 11.5 | 1337 | 1415 | 555 | 158 | 307 | 363 | 161 |
| 11.75 | 1342 | 1415 | 559 | 168 | 326 | 346 | 154 |
| 12 | 1347 | 1415 | 550 | 163 | 318 | 365 | 177 |
| 12.25 | 1351 | 1417 | 581 | 167 | 307 | 337 | 168 |
| 12.5 | 1356 | 1421 | 556 | 164 | 301 | 361 | 168 |
| 12.75 | 1360 | 1427 | 549 | 164 | 323 | 348 | 164 |
| 13 | 1364 | 1424 | 568 | 165 | 325 | 337 | 176 |
| 13.25 | 1369 | 1431 | 546 | 165 | 318 | 364 | 182 |
| 13.5 | 1373 | 1431 | 562 | 176 | 293 | 389 | 165 |

TABLE 1-continued

| Time (min) | E119 Std Average (° F.) | Burn Room (° F.) | Pass/Fail TC#11 | Pass/Fail TC#14 | Pass/Fail TC#15 | Pass/Fail TC#16 | Pass/Fail TC#17 |
|---|---|---|---|---|---|---|---|
| 13.75 | 1377 | 1438 | 556 | 152 | 297 | 410 | 161 |
| 14 | 1381 | 1434 | 558 | 162 | 291 | 379 | 172 |
| 14.25 | 1385 | 1432 | 567 | 148 | 307 | 365 | 175 |
| 14.5 | 1388 | 1439 | 555 | 157 | 302 | 387 | 163 |
| 14.75 | 1392 | 1434 | 568 | 160 | 312 | 371 | 166 |
| 15 | 1396 | 1434 | 536 | 152 | 337 | 388 | 173 |
| 15.25 | 1400 | 1491 | 606 | 166 | 350 | 399 | 177 |
| 15.5 | 1403 | 1520 | 608 | 171 | 359 | 378 | 178 |
| 15.75 | 1407 | 1531 | 609 | 196 | 338 | 402 | 174 |
| 16 | 1410 | 1534 | 599 | 186 | 348 | 395 | 172 |
| 16.25 | 1414 | 1534 | 625 | 174 | 352 | 415 | 185 |
| 16.5 | 1417 | 1546 | 641 | 166 | 346 | 371 | 176 |
| 16.75 | 1420 | 1535 | 633 | 158 | 337 | 424 | 168 |
| 17 | 1424 | 1533 | 644 | 153 | 331 | 418 | 190 |
| 17.25 | 1427 | 1554 | 662 | 155 | 343 | 396 | 176 |
| 17.5 | 1430 | 1549 | 626 | 174 | 337 | 427 | 195 |
| 17.75 | 1433 | 1558 | 663 | 179 | 362 | 427 | 193 |
| 18 | 1436 | 1556 | 644 | 181 | 340 | 474 | 187 |
| 18.25 | 1439 | 1570 | 654 | 178 | 351 | 422 | 181 |
| 18.5 | 1442 | 1547 | 639 | 180 | 361 | 417 | 180 |
| 18.75 | 1445 | 1560 | 642 | 157 | 335 | 434 | 184 |
| 19 | 1448 | 1555 | 643 | 173 | 367 | 433 | 192 |
| 19.25 | 1451 | 1554 | 635 | 175 | 335 | 446 | 188 |
| 19.5 | 1454 | 1556 | 662 | 163 | 351 | 407 | 186 |
| 19.75 | 1457 | 1569 | 639 | 197 | 334 | 414 | 181 |
| 20 | 1459 | 1564 | 633 | 177 | 370 | 403 | 203 |
| 20.25 | 1462 | 1575 | 690 | 173 | 378 | 451 | 180 |
| 20.5 | 1465 | 1576 | 696 | 190 | 371 | 402 | 191 |
| 20.75 | 1467 | 1571 | 710 | 181 | 389 | 425 | 217 |
| 21 | 1470 | 1576 | 681 | 192 | 391 | 430 | 176 |
| 21.25 | 1473 | 1560 | 679 | 180 | 366 | 441 | 193 |
| 21.5 | 1475 | 1572 | 679 | 182 | 336 | 415 | 188 |
| 21.75 | 1478 | 1581 | 653 | 187 | 354 | 451 | 187 |
| 22 | 1480 | 1544 | 683 | 183 | 342 | 467 | 189 |
| 22.25 | 1483 | 1548 | 671 | 193 | 388 | 443 | 210 |
| 22.5 | 1485 | 1551 | 695 | 194 | 411 | 459 | 177 |
| 22.75 | 1488 | 1549 | 686 | 173 | 361 | 435 | 192 |
| 23 | 1490 | 1557 | 670 | 172 | 361 | 431 | 186 |
| 23.25 | 1493 | 1554 | 670 | 181 | 355 | 449 | 190 |
| 23.5 | 1495 | 1553 | 671 | 176 | 362 | 425 | 205 |
| 23.75 | 1497 | 1569 | 681 | 171 | 326 | 434 | 178 |
| 24 | 1499 | 1586 | 648 | 208 | 369 | 444 | 200 |
| 24.25 | 1502 | 1591 | 671 | 197 | 354 | 469 | 208 |
| 24.5 | 1504 | 1582 | 667 | 180 | 364 | 473 | 209 |
| 24.75 | 1506 | 1599 | 676 | 176 | 391 | 468 | 198 |
| 25 | 1508 | 1589 | 704 | 194 | 401 | 445 | 212 |
| 25.25 | 1511 | 1607 | 722 | 198 | 414 | 451 | 218 |
| 25.5 | 1513 | 1643 | 719 | 195 | 390 | 449 | 203 |
| 25.75 | 1515 | 1627 | 745 | 186 | 409 | 459 | 212 |
| 26 | 1517 | 1637 | 718 | 179 | 432 | 430 | 204 |
| 26.25 | 1519 | 1634 | 736 | 176 | 399 | 445 | 216 |
| 26.5 | 1521 | 1653 | 730 | 179 | 433 | 420 | 200 |
| 26.75 | 1523 | 1633 | 761 | 168 | 399 | 437 | 188 |
| 27 | 1525 | 1650 | 751 | 186 | 408 | 467 | 176 |
| 27.25 | 1527 | 1654 | 716 | 187 | 426 | 396 | 157 |
| 27.5 | 1529 | 1666 | 729 | 183 | 420 | 359 | 152 |
| 27.75 | 1531 | 1662 | 739 | 197 | 446 | 406 | 180 |
| 28 | 1533 | 1674 | 728 | 188 | 392 | 444 | 190 |
| 28.25 | 1535 | 1668 | 747 | 186 | 422 | 468 | 193 |
| 28.5 | 1537 | 1657 | 751 | 190 | 431 | 436 | 177 |
| 28.75 | 1539 | 1672 | 766 | 198 | 415 | 447 | 199 |
| 29 | 1541 | 1671 | 738 | 187 | 402 | 443 | 177 |
| 29.25 | 1543 | 1668 | 705 | 186 | 378 | 477 | 205 |
| 29.5 | 1545 | 1670 | 779 | 175 | 438 | 435 | 189 |
| 29.75 | 1547 | 1676 | 763 | 183 | 421 | 431 | 180 |
| 30 | 1549 | 1675 | 748 | 187 | 386 | 485 | 181 |
| 30.25 | 1550 | 1445 | 566 | 167 | 326 | 356 | 172 |
| 30.5 | 1552 | 1215 | 454 | 146 | 273 | 285 | 143 |
| 30.75 | 1554 | 1111 | 444 | 136 | 247 | 249 | 128 |
| 31 | 1556 | 1034 | 412 | 134 | 233 | 247 | 130 |
| 31.25 | 1558 | 983 | 421 | 138 | 222 | 248 | 121 |
| 31.5 | 1559 | 939 | 416 | 127 | 216 | 243 | 123 |
| 31.75 | 1561 | 906 | 400 | 127 | 207 | 240 | 118 |
| 32 | 1563 | 873 | 383 | 127 | 216 | 228 | 117 |
| 32.25 | 1565 | 847 | 380 | 122 | 211 | 215 | 117 |
| 32.5 | 1566 | 820 | 380 | 124 | 201 | 204 | 118 |

TABLE 1-continued

| Time (min) | E119 Std Average (° F.) | Burn Room (° F.) | Pass/Fail TC#11 | Pass/Fail TC#14 | Pass/Fail TC#15 | Pass/Fail TC#16 | Pass/Fail TC#17 |
|---|---|---|---|---|---|---|---|
| 32.75 | 1568 | 800 | 373 | 126 | 201 | 201 | 119 |
| 33 | 1570 | 777 | 368 | 123 | 194 | 191 | 115 |
| 33.25 | 1571 | 760 | 362 | 119 | 190 | 192 | 114 |
| 33.5 | 1573 | 742 | 349 | 121 | 190 | 197 | 114 |
| 33.75 | 1575 | 727 | 326 | 119 | 186 | 198 | 113 |
| 34 | 1576 | 710 | 331 | 120 | 189 | 185 | 113 |
| 34.25 | 1578 | 697 | 329 | 118 | 186 | 181 | 108 |
| 34.5 | 1579 | 683 | 328 | 118 | 175 | 186 | 110 |
| 34.75 | 1581 | 671 | 320 | 115 | 177 | 171 | 112 |
| 35 | 1583 | 658 | 308 | 111 | 173 | 168 | 108 |
| 35.25 | 1584 | 648 | 308 | 113 | 179 | 170 | 110 |
| 35.5 | 1586 | 637 | 309 | 114 | 171 | 168 | 108 |
| 35.75 | 1587 | 627 | 300 | 117 | 170 | 172 | 111 |
| 36 | 1589 | 617 | 291 | 115 | 168 | 166 | 110 |
| 36.25 | 1590 | 608 | 292 | 111 | 164 | 165 | 109 |
| 36.5 | 1592 | 599 | 288 | 113 | 169 | 166 | 109 |
| 36.75 | 1593 | 591 | 288 | 113 | 166 | 160 | 107 |
| 37 | 1595 | 582 | 277 | 112 | 162 | 157 | 107 |
| 37.25 | 1596 | 575 | 264 | 112 | 164 | 163 | 106 |
| 37.5 | 1598 | 566 | 269 | 112 | 164 | 162 | 108 |
| 37.75 | 1599 | 559 | 264 | 109 | 154 | 160 | 108 |
| 38 | 1601 | 552 | 257 | 109 | 156 | 163 | 105 |
| 38.25 | 1602 | 545 | 252 | 111 | 152 | 154 | 106 |
| 38.5 | 1604 | 539 | 256 | 108 | 155 | 153 | 107 |
| 38.75 | 1605 | 533 | 251 | 107 | 156 | 156 | 105 |
| 39 | 1606 | 526 | 239 | 106 | 150 | 158 | 105 |
| 39.25 | 1608 | 519 | 249 | 108 | 146 | 151 | 103 |
| 39.5 | 1609 | 513 | 249 | 108 | 151 | 145 | 105 |
| 39.75 | 1611 | 508 | 249 | 105 | 147 | 146 | 102 |
| 40 | 1612 | 502 | 237 | 106 | 147 | 148 | 102 |

TABLE 2

| Time (min) | E119 Std Average (° F.) | Burn Room (° F.) | Pass/ Fail TC#18 | Pass/ Fail TC#19 | Pass/ Fail TC#28 | Pass/ Fail TC#31 | Pass/ Fail TC#32 | Pass/ Fail TC#33 | Pass/ Fail TC#34 | Pass/ Fail TC#35 | Pass/ Fail TC#36 | Pass/ Fail TC#37 | Pass/ Fail TC#38 | Pass/ Fail TC#39 | Pass/ Fail TC#40 |
|---|---|---|---|---|---|---|---|---|---|---|---|---|---|---|---|
| 0 | 68 | 93 | 87 | 86 | 84 | 85 | 84 | 84 | 85 | 85 | 84 | 84 | 85 | 85 | 86 |
| 0.25 | 115 | 537 | 87 | 86 | 84 | 85 | 85 | 85 | 85 | 85 | 84 | 84 | 85 | 85 | 86 |
| 0.5 | 161 | 945 | 87 | 86 | 83 | 85 | 85 | 85 | 85 | 85 | 84 | 84 | 85 | 85 | 86 |
| 0.75 | 208 | 1080 | 87 | 86 | 84 | 85 | 85 | 85 | 85 | 85 | 84 | 84 | 85 | 85 | 86 |
| 1 | 254 | 1146 | 87 | 86 | 84 | 85 | 85 | 85 | 85 | 85 | 84 | 84 | 85 | 85 | 86 |
| 1.25 | 301 | 1187 | 87 | 86 | 83 | 85 | 85 | 85 | 85 | 85 | 84 | 84 | 85 | 85 | 86 |
| 1.5 | 348 | 1219 | 87 | 86 | 84 | 85 | 84 | 84 | 85 | 85 | 84 | 84 | 85 | 85 | 86 |
| 1.75 | 394 | 1233 | 87 | 86 | 84 | 85 | 85 | 85 | 85 | 85 | 84 | 84 | 85 | 85 | 86 |
| 2 | 441 | 1239 | 87 | 86 | 84 | 85 | 85 | 85 | 85 | 85 | 84 | 84 | 85 | 85 | 86 |
| 2.25 | 487 | 1244 | 87 | 86 | 84 | 85 | 85 | 85 | 85 | 85 | 84 | 84 | 85 | 86 | 86 |
| 2.5 | 534 | 1250 | 87 | 86 | 85 | 85 | 85 | 85 | 85 | 86 | 84 | 84 | 85 | 86 | 86 |
| 2.75 | 581 | 1266 | 87 | 86 | 85 | 85 | 85 | 85 | 85 | 86 | 85 | 84 | 85 | 86 | 86 |
| 3 | 627 | 1277 | 87 | 86 | 86 | 85 | 85 | 85 | 85 | 86 | 84 | 85 | 85 | 86 | 86 |
| 3.25 | 674 | 1288 | 87 | 86 | 87 | 85 | 85 | 85 | 85 | 86 | 85 | 85 | 85 | 86 | 87 |
| 3.5 | 720 | 1301 | 87 | 86 | 87 | 85 | 85 | 85 | 86 | 86 | 85 | 85 | 85 | 86 | 87 |
| 3.75 | 767 | 1319 | 87 | 86 | 88 | 85 | 85 | 85 | 86 | 87 | 85 | 85 | 85 | 86 | 87 |
| 4 | 814 | 1327 | 87 | 86 | 89 | 85 | 85 | 85 | 86 | 87 | 85 | 85 | 85 | 86 | 87 |
| 4.25 | 860 | 1359 | 87 | 86 | 90 | 85 | 85 | 85 | 86 | 87 | 85 | 85 | 85 | 86 | 87 |
| 4.5 | 907 | 1362 | 87 | 86 | 91 | 85 | 85 | 85 | 86 | 87 | 85 | 85 | 86 | 86 | 88 |
| 4.75 | 953 | 1365 | 87 | 86 | 92 | 85 | 85 | 85 | 86 | 88 | 85 | 85 | 86 | 86 | 88 |
| 5 | 1000 | 1360 | 88 | 87 | 93 | 85 | 85 | 85 | 86 | 88 | 85 | 85 | 86 | 86 | 88 |
| 5.25 | 1015 | 1363 | 88 | 87 | 95 | 85 | 85 | 85 | 86 | 89 | 85 | 85 | 86 | 86 | 89 |
| 5.5 | 1030 | 1364 | 88 | 87 | 96 | 85 | 85 | 85 | 86 | 89 | 85 | 86 | 86 | 87 | 89 |
| 5.75 | 1045 | 1373 | 89 | 87 | 97 | 85 | 85 | 86 | 86 | 89 | 85 | 86 | 86 | 87 | 90 |
| 6 | 1060 | 1366 | 89 | 87 | 98 | 85 | 85 | 86 | 86 | 90 | 85 | 86 | 86 | 87 | 90 |
| 6.25 | 1075 | 1366 | 89 | 88 | 99 | 85 | 85 | 86 | 86 | 90 | 85 | 86 | 86 | 87 | 91 |
| 6.5 | 1090 | 1367 | 90 | 88 | 101 | 85 | 85 | 86 | 86 | 91 | 85 | 86 | 86 | 87 | 91 |
| 6.75 | 1105 | 1372 | 90 | 88 | 102 | 86 | 85 | 86 | 87 | 91 | 85 | 86 | 86 | 87 | 92 |
| 7 | 1120 | 1369 | 91 | 89 | 104 | 86 | 86 | 86 | 87 | 92 | 86 | 87 | 86 | 88 | 92 |
| 7.25 | 1135 | 1371 | 91 | 89 | 105 | 86 | 86 | 86 | 87 | 92 | 86 | 87 | 86 | 88 | 93 |
| 7.5 | 1150 | 1376 | 92 | 89 | 107 | 86 | 86 | 86 | 87 | 93 | 86 | 87 | 87 | 88 | 93 |
| 7.75 | 1165 | 1386 | 92 | 90 | 108 | 86 | 86 | 86 | 87 | 93 | 86 | 87 | 87 | 88 | 94 |
| 8 | 1180 | 1382 | 93 | 90 | 110 | 86 | 86 | 87 | 87 | 94 | 86 | 87 | 87 | 88 | 94 |
| 8.25 | 1195 | 1388 | 94 | 91 | 112 | 86 | 86 | 87 | 87 | 95 | 86 | 87 | 87 | 89 | 95 |
| 8.5 | 1210 | 1389 | 94 | 91 | 113 | 86 | 86 | 87 | 87 | 95 | 86 | 88 | 87 | 89 | 96 |

TABLE 2-continued

| Time (min) | E119 Std Average (° F.) | Burn Room (° F.) | Pass/ Fail TC#18 | Pass/ Fail TC#19 | Pass/ Fail TC#28 | Pass/ Fail TC#31 | Pass/ Fail TC#32 | Pass/ Fail TC#33 | Pass/ Fail TC#34 | Pass/ Fail TC#35 | Pass/ Fail TC#36 | Pass/ Fail TC#37 | Pass/ Fail TC#38 | Pass/ Fail TC#39 | Pass/ Fail TC#40 |
|---|---|---|---|---|---|---|---|---|---|---|---|---|---|---|---|
| 8.75 | 1225 | 1387 | 95 | 92 | 115 | 86 | 86 | 87 | 88 | 96 | 86 | 88 | 87 | 89 | 97 |
| 9 | 1240 | 1390 | 95 | 92 | 117 | 86 | 86 | 87 | 88 | 97 | 86 | 88 | 87 | 89 | 97 |
| 9.25 | 1255 | 1392 | 96 | 93 | 119 | 87 | 87 | 87 | 88 | 97 | 87 | 88 | 87 | 89 | 98 |
| 9.5 | 1270 | 1396 | 97 | 93 | 121 | 87 | 87 | 88 | 88 | 98 | 87 | 88 | 88 | 90 | 99 |
| 9.75 | 1285 | 1401 | 97 | 94 | 123 | 87 | 87 | 88 | 88 | 99 | 87 | 89 | 88 | 90 | 99 |
| 10 | 1300 | 1397 | 98 | 94 | 125 | 87 | 87 | 88 | 89 | 99 | 87 | 89 | 88 | 90 | 100 |
| 10.25 | 1312 | 1397 | 99 | 95 | 127 | 87 | 87 | 88 | 89 | 100 | 87 | 89 | 88 | 91 | 101 |
| 10.5 | 1317 | 1405 | 100 | 95 | 129 | 87 | 87 | 89 | 89 | 101 | 87 | 89 | 88 | 91 | 102 |
| 10.75 | 1323 | 1406 | 100 | 96 | 131 | 87 | 88 | 89 | 89 | 102 | 87 | 90 | 88 | 91 | 103 |
| 11 | 1328 | 1409 | 101 | 97 | 133 | 88 | 88 | 89 | 89 | 102 | 88 | 90 | 89 | 91 | 104 |
| 11.25 | 1333 | 1396 | 102 | 97 | 135 | 88 | 88 | 89 | 90 | 103 | 88 | 90 | 89 | 92 | 105 |
| 11.5 | 1337 | 1415 | 102 | 98 | 137 | 88 | 88 | 89 | 90 | 104 | 88 | 90 | 89 | 92 | 105 |
| 11.75 | 1342 | 1415 | 103 | 98 | 140 | 88 | 88 | 90 | 90 | 105 | 88 | 91 | 89 | 92 | 106 |
| 12 | 1347 | 1415 | 104 | 99 | 142 | 88 | 88 | 90 | 91 | 106 | 89 | 91 | 90 | 92 | 108 |
| 12.25 | 1351 | 1417 | 104 | 99 | 145 | 89 | 89 | 90 | 91 | 106 | 89 | 91 | 90 | 93 | 108 |
| 12.5 | 1356 | 1421 | 105 | 100 | 148 | 89 | 89 | 91 | 91 | 107 | 89 | 92 | 90 | 93 | 110 |
| 12.75 | 1360 | 1427 | 106 | 100 | 150 | 89 | 90 | 91 | 91 | 108 | 89 | 92 | 90 | 93 | 111 |
| 13 | 1364 | 1424 | 106 | 101 | 154 | 89 | 90 | 91 | 91 | 109 | 89 | 92 | 90 | 93 | 112 |
| 13.25 | 1369 | 1431 | 107 | 102 | 156 | 89 | 90 | 91 | 92 | 110 | 90 | 93 | 91 | 94 | 112 |
| 13.5 | 1373 | 1431 | 108 | 102 | 160 | 90 | 90 | 92 | 92 | 110 | 90 | 93 | 91 | 94 | 113 |
| 13.75 | 1377 | 1438 | 108 | 103 | 163 | 90 | 91 | 92 | 92 | 111 | 90 | 93 | 91 | 94 | 115 |
| 14 | 1381 | 1434 | 109 | 103 | 168 | 90 | 91 | 92 | 93 | 112 | 90 | 93 | 91 | 95 | 116 |
| 14.25 | 1385 | 1432 | 110 | 104 | 172 | 90 | 91 | 92 | 93 | 113 | 91 | 94 | 92 | 95 | 117 |
| 14.5 | 1388 | 1439 | 110 | 104 | 179 | 91 | 91 | 93 | 93 | 114 | 91 | 94 | 92 | 95 | 118 |
| 14.75 | 1392 | 1434 | 111 | 105 | 188 | 91 | 92 | 93 | 93 | 115 | 91 | 94 | 92 | 95 | 119 |
| 15 | 1396 | 1434 | 112 | 106 | 198 | 91 | 92 | 93 | 94 | 116 | 91 | 94 | 92 | 96 | 120 |
| 15.25 | 1400 | 1491 | 113 | 106 | 203 | 92 | 92 | 94 | 94 | 117 | 92 | 95 | 92 | 96 | 121 |
| 15.5 | 1403 | 1520 | 113 | 107 | 205 | 92 | 93 | 94 | 94 | 118 | 92 | 95 | 93 | 96 | 122 |
| 15.75 | 1407 | 1531 | 114 | 107 | 207 | 92 | 93 | 94 | 94 | 119 | 92 | 95 | 93 | 97 | 123 |
| 16 | 1410 | 1534 | 115 | 108 | 208 | 92 | 93 | 94 | 95 | 120 | 92 | 96 | 93 | 97 | 125 |
| 16.25 | 1414 | 1534 | 116 | 108 | 209 | 93 | 93 | 95 | 95 | 121 | 93 | 96 | 93 | 97 | 126 |
| 16.5 | 1417 | 1546 | 117 | 109 | 209 | 93 | 94 | 95 | 95 | 122 | 93 | 96 | 93 | 98 | 127 |
| 16.75 | 1420 | 1535 | 118 | 109 | 209 | 93 | 94 | 95 | 95 | 123 | 93 | 97 | 94 | 98 | 128 |
| 17 | 1424 | 1533 | 119 | 110 | 210 | 94 | 94 | 96 | 96 | 124 | 93 | 97 | 94 | 98 | 129 |
| 17.25 | 1427 | 1554 | 120 | 111 | 210 | 94 | 95 | 96 | 96 | 125 | 94 | 97 | 94 | 98 | 130 |
| 17.5 | 1430 | 1549 | 122 | 111 | 211 | 94 | 95 | 96 | 97 | 126 | 94 | 98 | 94 | 99 | 132 |
| 17.75 | 1433 | 1558 | 123 | 112 | 211 | 94 | 95 | 97 | 97 | 127 | 94 | 98 | 95 | 99 | 133 |
| 18 | 1436 | 1556 | 123 | 113 | 211 | 95 | 96 | 97 | 97 | 128 | 94 | 98 | 95 | 99 | 134 |
| 18.25 | 1439 | 1570 | 125 | 113 | 211 | 95 | 96 | 98 | 98 | 129 | 95 | 99 | 95 | 100 | 136 |
| 18.5 | 1442 | 1547 | 126 | 114 | 211 | 96 | 97 | 98 | 98 | 130 | 95 | 99 | 96 | 100 | 137 |
| 18.75 | 1445 | 1560 | 127 | 115 | 211 | 96 | 97 | 98 | 98 | 131 | 95 | 99 | 96 | 101 | 138 |
| 19 | 1448 | 1555 | 128 | 115 | 211 | 97 | 97 | 99 | 99 | 133 | 96 | 100 | 96 | 101 | 140 |
| 19.25 | 1451 | 1554 | 129 | 116 | 211 | 97 | 98 | 99 | 99 | 134 | 96 | 100 | 97 | 101 | 141 |
| 19.5 | 1454 | 1556 | 130 | 117 | 211 | 97 | 98 | 99 | 99 | 135 | 96 | 100 | 97 | 102 | 143 |
| 19.75 | 1457 | 1569 | 131 | 118 | 211 | 98 | 98 | 100 | 100 | 136 | 97 | 101 | 97 | 102 | 144 |
| 20 | 1459 | 1564 | 132 | 119 | 211 | 98 | 99 | 100 | 100 | 138 | 97 | 101 | 97 | 102 | 146 |
| 20.25 | 1462 | 1575 | 133 | 120 | 211 | 98 | 99 | 100 | 100 | 139 | 97 | 102 | 98 | 103 | 148 |
| 20.5 | 1465 | 1576 | 135 | 121 | 212 | 99 | 100 | 101 | 101 | 140 | 98 | 102 | 98 | 103 | 150 |
| 20.75 | 1467 | 1571 | 136 | 122 | 214 | 99 | 100 | 101 | 101 | 142 | 98 | 102 | 98 | 103 | 151 |
| 21 | 1470 | 1576 | 137 | 123 | 216 | 100 | 100 | 102 | 101 | 143 | 99 | 103 | 99 | 104 | 153 |
| 21.25 | 1473 | 1560 | 139 | 124 | 218 | 100 | 101 | 102 | 102 | 145 | 99 | 103 | 99 | 104 | 155 |
| 21.5 | 1475 | 1572 | 141 | 126 | 219 | 101 | 101 | 102 | 102 | 146 | 99 | 104 | 100 | 105 | 157 |
| 21.75 | 1478 | 1581 | 142 | 127 | 220 | 101 | 102 | 103 | 103 | 147 | 100 | 104 | 100 | 105 | 159 |
| 22 | 1480 | 1544 | 144 | 129 | 222 | 102 | 102 | 103 | 103 | 149 | 100 | 105 | 100 | 105 | 162 |
| 22.25 | 1483 | 1548 | 145 | 130 | 222 | 102 | 102 | 104 | 103 | 150 | 100 | 105 | 101 | 106 | 164 |
| 22.5 | 1485 | 1551 | 147 | 131 | 223 | 103 | 103 | 104 | 104 | 152 | 101 | 106 | 101 | 106 | 167 |
| 22.75 | 1488 | 1549 | 148 | 132 | 224 | 103 | 103 | 104 | 104 | 153 | 101 | 106 | 101 | 107 | 170 |
| 23 | 1490 | 1557 | 149 | 134 | 224 | 104 | 104 | 105 | 105 | 155 | 102 | 107 | 102 | 107 | 177 |
| 23.25 | 1493 | 1554 | 151 | 135 | 225 | 105 | 104 | 105 | 105 | 156 | 102 | 107 | 102 | 108 | 193 |
| 23.5 | 1495 | 1553 | 152 | 137 | 226 | 106 | 105 | 106 | 106 | 158 | 103 | 108 | 103 | 108 | 204 |
| 23.75 | 1497 | 1569 | 153 | 138 | 227 | 106 | 105 | 106 | 106 | 159 | 103 | 108 | 103 | 108 | 207 |
| 24 | 1499 | 1586 | 155 | 139 | 227 | 107 | 106 | 107 | 106 | 161 | 103 | 108 | 103 | 109 | 208 |
| 24.25 | 1502 | 1591 | 156 | 140 | 228 | 107 | 106 | 107 | 107 | 163 | 104 | 109 | 104 | 110 | 208 |
| 24.5 | 1504 | 1582 | 157 | 141 | 230 | 108 | 107 | 108 | 107 | 164 | 104 | 109 | 104 | 110 | 209 |
| 24.75 | 1506 | 1599 | 158 | 142 | 231 | 109 | 107 | 108 | 107 | 166 | 105 | 110 | 105 | 110 | 209 |
| 25 | 1508 | 1589 | 159 | 143 | 233 | 110 | 107 | 109 | 108 | 167 | 105 | 110 | 105 | 111 | 209 |
| 25.25 | 1511 | 1607 | 160 | 144 | 235 | 110 | 108 | 109 | 108 | 169 | 106 | 111 | 106 | 111 | 210 |
| 25.5 | 1513 | 1643 | 160 | 145 | 237 | 111 | 108 | 110 | 109 | 171 | 106 | 111 | 106 | 112 | 210 |
| 25.75 | 1515 | 1627 | 161 | 146 | 238 | 112 | 109 | 110 | 109 | 172 | 107 | 112 | 107 | 112 | 210 |
| 26 | 1517 | 1637 | 162 | 147 | 239 | 113 | 109 | 110 | 110 | 174 | 107 | 112 | 107 | 113 | 210 |
| 26.25 | 1519 | 1634 | 163 | 147 | 240 | 114 | 110 | 111 | 110 | 176 | 108 | 113 | 107 | 113 | 210 |
| 26.5 | 1521 | 1653 | 163 | 148 | 239 | 115 | 110 | 112 | 111 | 178 | 108 | 113 | 108 | 114 | 210 |
| 26.75 | 1523 | 1633 | 164 | 149 | 235 | 116 | 111 | 112 | 111 | 180 | 109 | 114 | 108 | 114 | 210 |
| 27 | 1525 | 1650 | 165 | 150 | 229 | 117 | 111 | 113 | 112 | 183 | 109 | 114 | 109 | 115 | 210 |
| 27.25 | 1527 | 1654 | 165 | 151 | 226 | 118 | 112 | 113 | 112 | 186 | 110 | 115 | 109 | 115 | 210 |

TABLE 2-continued

| Time (min) | E119 Std Average (° F.) | Burn Room (° F.) | Pass/ Fail TC#18 | Pass/ Fail TC#19 | Pass/ Fail TC#28 | Pass/ Fail TC#31 | Pass/ Fail TC#32 | Pass/ Fail TC#33 | Pass/ Fail TC#34 | Pass/ Fail TC#35 | Pass/ Fail TC#36 | Pass/ Fail TC#37 | Pass/ Fail TC#38 | Pass/ Fail TC#39 | Pass/ Fail TC#40 |
|---|---|---|---|---|---|---|---|---|---|---|---|---|---|---|---|
| 27.5 | 1529 | 1666 | 166 | 151 | 223 | 119 | 112 | 113 | 112 | 190 | 110 | 115 | 110 | 116 | 210 |
| 27.75 | 1531 | 1662 | 167 | 152 | 221 | 120 | 113 | 114 | 113 | 194 | 111 | 116 | 110 | 116 | 210 |
| 28 | 1533 | 1674 | 167 | 153 | 219 | 121 | 113 | 114 | 113 | 199 | 111 | 116 | 111 | 117 | 210 |
| 28.25 | 1535 | 1668 | 168 | 153 | 218 | 122 | 114 | 115 | 114 | 202 | 112 | 117 | 111 | 117 | 210 |
| 28.5 | 1537 | 1657 | 168 | 154 | 218 | 123 | 114 | 115 | 114 | 205 | 112 | 117 | 112 | 118 | 210 |
| 28.75 | 1539 | 1672 | 169 | 154 | 218 | 124 | 115 | 116 | 115 | 206 | 113 | 118 | 112 | 118 | 210 |
| 29 | 1541 | 1671 | 170 | 155 | 218 | 125 | 115 | 116 | 115 | 207 | 113 | 118 | 113 | 119 | 210 |
| 29.25 | 1543 | 1668 | 170 | 155 | 218 | 126 | 116 | 117 | 116 | 208 | 114 | 119 | 113 | 119 | 210 |
| 29.5 | 1545 | 1670 | 171 | 156 | 218 | 127 | 116 | 117 | 116 | 209 | 114 | 119 | 114 | 120 | 210 |
| 29.75 | 1547 | 1676 | 171 | 156 | 218 | 128 | 117 | 118 | 117 | 209 | 115 | 120 | 114 | 120 | 210 |
| 30 | 1549 | 1675 | 171 | 157 | 218 | 129 | 117 | 118 | 117 | 209 | 115 | 120 | 115 | 121 | 210 |
| 30.25 | 1550 | 1445 | 172 | 158 | 218 | 129 | 118 | 119 | 118 | 209 | 116 | 121 | 115 | 121 | 210 |
| 30.5 | 1552 | 1215 | 173 | 158 | 219 | 130 | 118 | 120 | 118 | 210 | 116 | 121 | 116 | 121 | 210 |
| 30.75 | 1554 | 1111 | 173 | 159 | 219 | 131 | 119 | 120 | 119 | 210 | 117 | 122 | 117 | 122 | 210 |
| 31 | 1556 | 1034 | 174 | 159 | 220 | 132 | 120 | 121 | 119 | 210 | 117 | 122 | 117 | 123 | 210 |
| 31.25 | 1558 | 983 | 174 | 160 | 220 | 133 | 120 | 121 | 120 | 209 | 118 | 123 | 118 | 123 | 210 |
| 31.5 | 1559 | 939 | 175 | 160 | 221 | 134 | 120 | 122 | 120 | 209 | 118 | 123 | 118 | 124 | 210 |
| 31.75 | 1561 | 906 | 175 | 161 | 221 | 135 | 121 | 122 | 121 | 209 | 119 | 124 | 119 | 124 | 209 |
| 32 | 1563 | 873 | 176 | 161 | 221 | 135 | 121 | 122 | 121 | 209 | 119 | 124 | 119 | 124 | 209 |
| 32.25 | 1565 | 847 | 177 | 162 | 221 | 136 | 122 | 123 | 121 | 209 | 120 | 124 | 120 | 125 | 209 |
| 32.5 | 1566 | 820 | 177 | 162 | 222 | 137 | 122 | 123 | 122 | 208 | 120 | 125 | 120 | 125 | 208 |
| 32.75 | 1568 | 800 | 178 | 163 | 222 | 137 | 123 | 124 | 122 | 208 | 121 | 125 | 121 | 126 | 208 |
| 33 | 1570 | 777 | 178 | 163 | 223 | 138 | 123 | 124 | 123 | 208 | 121 | 126 | 121 | 126 | 208 |
| 33.25 | 1571 | 760 | 179 | 164 | 223 | 138 | 123 | 124 | 123 | 207 | 121 | 126 | 121 | 126 | 207 |
| 33.5 | 1573 | 742 | 179 | 164 | 223 | 139 | 124 | 125 | 123 | 207 | 122 | 126 | 122 | 127 | 207 |
| 33.75 | 1575 | 727 | 180 | 165 | 224 | 139 | 124 | 125 | 124 | 206 | 122 | 126 | 122 | 127 | 206 |
| 34 | 1576 | 710 | 180 | 165 | 224 | 139 | 124 | 125 | 124 | 206 | 123 | 127 | 123 | 127 | 206 |
| 34.25 | 1578 | 697 | 181 | 165 | 225 | 140 | 125 | 126 | 124 | 205 | 123 | 127 | 123 | 128 | 205 |
| 34.5 | 1579 | 683 | 181 | 166 | 225 | 140 | 125 | 126 | 124 | 205 | 123 | 127 | 124 | 128 | 205 |
| 34.75 | 1581 | 671 | 182 | 166 | 227 | 140 | 125 | 126 | 125 | 205 | 124 | 127 | 124 | 128 | 205 |
| 35 | 1583 | 658 | 182 | 167 | 228 | 140 | 125 | 126 | 125 | 204 | 124 | 128 | 124 | 128 | 204 |
| 35.25 | 1584 | 648 | 182 | 167 | 230 | 141 | 126 | 127 | 125 | 204 | 124 | 128 | 125 | 129 | 204 |
| 35.5 | 1586 | 637 | 183 | 167 | 232 | 141 | 126 | 127 | 126 | 203 | 124 | 128 | 125 | 129 | 204 |
| 35.75 | 1587 | 627 | 183 | 167 | 236 | 141 | 126 | 127 | 126 | 203 | 125 | 128 | 126 | 129 | 203 |
| 36 | 1589 | 617 | 184 | 168 | 243 | 141 | 126 | 127 | 126 | 202 | 125 | 128 | 126 | 129 | 203 |
| 36.25 | 1590 | 608 | 184 | 168 | 252 | 141 | 127 | 128 | 126 | 202 | 125 | 128 | 126 | 129 | 203 |
| 36.5 | 1592 | 599 | 185 | 168 | 261 | 141 | 127 | 128 | 126 | 201 | 126 | 129 | 126 | 130 | 202 |
| 36.75 | 1593 | 591 | 185 | 168 | 269 | 141 | 127 | 128 | 126 | 201 | 126 | 129 | 127 | 130 | 202 |
| 37 | 1595 | 582 | 185 | 169 | 274 | 142 | 127 | 128 | 127 | 200 | 126 | 129 | 127 | 130 | 201 |
| 37.25 | 1596 | 575 | 186 | 169 | 277 | 141 | 127 | 128 | 127 | 200 | 126 | 129 | 127 | 130 | 201 |
| 37.5 | 1598 | 566 | 186 | 169 | 279 | 142 | 127 | 128 | 127 | 200 | 127 | 129 | 128 | 131 | 201 |
| 37.75 | 1599 | 559 | 186 | 169 | 282 | 141 | 128 | 128 | 127 | 199 | 127 | 129 | 128 | 131 | 200 |
| 38 | 1601 | 552 | 187 | 170 | 285 | 141 | 128 | 128 | 127 | 199 | 127 | 129 | 128 | 131 | 200 |
| 38.25 | 1602 | 545 | 187 | 170 | 289 | 141 | 128 | 129 | 127 | 198 | 127 | 129 | 128 | 131 | 200 |
| 38.5 | 1604 | 539 | 187 | 170 | 292 | 141 | 128 | 129 | 128 | 198 | 127 | 129 | 129 | 131 | 199 |
| 38.75 | 1605 | 533 | 187 | 171 | 295 | 141 | 128 | 129 | 128 | 197 | 127 | 129 | 129 | 131 | 199 |
| 39 | 1606 | 526 | 187 | 171 | 298 | 141 | 128 | 129 | 128 | 197 | 127 | 130 | 129 | 131 | 199 |
| 39.25 | 1608 | 519 | 187 | 171 | 300 | 141 | 128 | 129 | 128 | 196 | 128 | 130 | 129 | 131 | 198 |
| 39.5 | 1609 | 513 | 188 | 172 | 302 | 141 | 128 | 129 | 128 | 196 | 128 | 130 | 129 | 131 | 198 |
| 39.75 | 1611 | 508 | 188 | 173 | 303 | 141 | 128 | 129 | 128 | 196 | 128 | 130 | 130 | 131 | 198 |
| 40 | 1612 | 502 | 188 | 174 | 304 | 141 | 128 | 129 | 128 | 195 | 128 | 130 | 130 | 132 | 197 |

TABLE 3

| Time (min) | E119 Std Average (° F.) | Burn Room (° F.) | Pass/Fail TC#49 | Pass/Fail TC#50 | Pass/Fail TC#51 | Pass/Fail TC#52 | Pass/Fail TC#53 | Pass/Fail TC#54 |
|---|---|---|---|---|---|---|---|---|
| 0 | 68 | 93 | 86 | 86 | 86 | 85 | 85 | 85 |
| 0.25 | 115 | 537 | 86 | 86 | 86 | 85 | 85 | 85 |
| 0.5 | 161 | 945 | 86 | 86 | 86 | 85 | 85 | 85 |
| 0.75 | 208 | 1080 | 86 | 86 | 86 | 85 | 85 | 85 |
| 1 | 254 | 1146 | 86 | 86 | 86 | 85 | 85 | 85 |
| 1.25 | 301 | 1187 | 86 | 86 | 86 | 85 | 85 | 85 |
| 1.5 | 348 | 1219 | 86 | 86 | 86 | 85 | 85 | 85 |
| 1.75 | 394 | 1233 | 87 | 87 | 86 | 86 | 85 | 85 |
| 2 | 441 | 1239 | 86 | 87 | 86 | 86 | 85 | 85 |
| 2.25 | 487 | 1244 | 86 | 87 | 86 | 86 | 85 | 86 |
| 2.5 | 534 | 1250 | 87 | 87 | 86 | 86 | 86 | 86 |
| 2.75 | 581 | 1266 | 87 | 87 | 86 | 86 | 86 | 86 |
| 3 | 627 | 1277 | 87 | 87 | 86 | 86 | 86 | 86 |
| 3.25 | 674 | 1288 | 87 | 87 | 86 | 86 | 86 | 86 |

TABLE 3-continued

| Time (min) | E119 Std Average (° F.) | Burn Room (° F.) | Pass/Fail TC#49 | Pass/Fail TC#50 | Pass/Fail TC#51 | Pass/Fail TC#52 | Pass/Fail TC#53 | Pass/Fail TC#54 |
|---|---|---|---|---|---|---|---|---|
| 3.5 | 720 | 1301 | 87 | 87 | 86 | 86 | 86 | 86 |
| 3.75 | 767 | 1319 | 87 | 87 | 86 | 86 | 85 | 85 |
| 4 | 814 | 1327 | 87 | 87 | 86 | 86 | 86 | 86 |
| 4.25 | 860 | 1359 | 87 | 87 | 86 | 86 | 86 | 86 |
| 4.5 | 907 | 1362 | 87 | 87 | 87 | 86 | 86 | 86 |
| 4.75 | 953 | 1365 | 87 | 87 | 86 | 86 | 86 | 86 |
| 5 | 1000 | 1360 | 87 | 87 | 86 | 86 | 86 | 86 |
| 5.25 | 1015 | 1363 | 87 | 87 | 86 | 86 | 86 | 86 |
| 5.5 | 1030 | 1364 | 87 | 87 | 87 | 86 | 86 | 86 |
| 5.75 | 1045 | 1373 | 87 | 87 | 87 | 86 | 86 | 86 |
| 6 | 1060 | 1366 | 87 | 87 | 87 | 86 | 86 | 86 |
| 6.25 | 1075 | 1366 | 87 | 87 | 86 | 86 | 86 | 86 |
| 6.5 | 1090 | 1367 | 87 | 87 | 87 | 86 | 86 | 86 |
| 6.75 | 1105 | 1372 | 87 | 87 | 87 | 86 | 86 | 87 |
| 7 | 1120 | 1369 | 87 | 87 | 86 | 86 | 86 | 86 |
| 7.25 | 1135 | 1371 | 87 | 87 | 87 | 86 | 86 | 87 |
| 7.5 | 1150 | 1376 | 87 | 88 | 87 | 86 | 86 | 87 |
| 7.75 | 1165 | 1386 | 87 | 88 | 87 | 86 | 86 | 87 |
| 8 | 1180 | 1382 | 87 | 88 | 87 | 86 | 86 | 87 |
| 8.25 | 1195 | 1388 | 87 | 89 | 87 | 86 | 86 | 87 |
| 8.5 | 1210 | 1389 | 87 | 88 | 87 | 87 | 87 | 87 |
| 8.75 | 1225 | 1387 | 87 | 88 | 87 | 87 | 87 | 87 |
| 9 | 1240 | 1390 | 87 | 89 | 87 | 87 | 87 | 87 |
| 9.25 | 1255 | 1392 | 87 | 90 | 87 | 87 | 87 | 87 |
| 9.5 | 1270 | 1396 | 87 | 89 | 87 | 86 | 86 | 87 |
| 9.75 | 1285 | 1401 | 87 | 89 | 87 | 87 | 87 | 87 |
| 10 | 1300 | 1397 | 87 | 89 | 87 | 87 | 87 | 88 |
| 10.25 | 1312 | 1397 | 87 | 89 | 87 | 86 | 86 | 88 |
| 10.5 | 1317 | 1405 | 87 | 88 | 87 | 86 | 86 | 88 |
| 10.75 | 1323 | 1406 | 87 | 88 | 88 | 86 | 86 | 88 |
| 11 | 1328 | 1409 | 88 | 90 | 87 | 87 | 87 | 88 |
| 11.25 | 1333 | 1396 | 88 | 91 | 87 | 87 | 87 | 88 |
| 11.5 | 1337 | 1415 | 88 | 92 | 87 | 87 | 87 | 88 |
| 11.75 | 1342 | 1415 | 88 | 90 | 87 | 87 | 87 | 88 |
| 12 | 1347 | 1415 | 88 | 91 | 88 | 87 | 87 | 88 |
| 12.25 | 1351 | 1417 | 87 | 91 | 88 | 87 | 87 | 88 |
| 12.5 | 1356 | 1421 | 88 | 90 | 88 | 88 | 88 | 88 |
| 12.75 | 1360 | 1427 | 88 | 92 | 88 | 87 | 87 | 89 |
| 13 | 1364 | 1424 | 88 | 94 | 88 | 87 | 87 | 89 |
| 13.25 | 1369 | 1431 | 88 | 91 | 88 | 87 | 87 | 89 |
| 13.5 | 1373 | 1431 | 88 | 90 | 88 | 87 | 87 | 89 |
| 13.75 | 1377 | 1438 | 89 | 90 | 88 | 88 | 88 | 89 |
| 14 | 1381 | 1434 | 90 | 92 | 88 | 89 | 89 | 89 |
| 14.25 | 1385 | 1432 | 89 | 92 | 88 | 88 | 88 | 90 |
| 14.5 | 1388 | 1439 | 89 | 91 | 88 | 88 | 88 | 89 |
| 14.75 | 1392 | 1434 | 89 | 94 | 88 | 88 | 88 | 89 |
| 15 | 1396 | 1434 | 89 | 95 | 88 | 88 | 89 | 90 |
| 15.25 | 1400 | 1491 | 89 | 93 | 88 | 88 | 88 | 90 |
| 15.5 | 1403 | 1520 | 89 | 93 | 89 | 88 | 88 | 91 |
| 15.75 | 1407 | 1531 | 89 | 94 | 89 | 88 | 90 | 91 |
| 16 | 1410 | 1534 | 89 | 93 | 89 | 88 | 89 | 91 |
| 16.25 | 1414 | 1534 | 89 | 93 | 89 | 88 | 88 | 91 |
| 16.5 | 1417 | 1546 | 89 | 93 | 89 | 88 | 89 | 91 |
| 16.75 | 1420 | 1535 | 90 | 92 | 89 | 88 | 89 | 91 |
| 17 | 1424 | 1533 | 90 | 95 | 89 | 89 | 91 | 90 |
| 17.25 | 1427 | 1554 | 90 | 94 | 89 | 89 | 90 | 91 |
| 17.5 | 1430 | 1549 | 89 | 93 | 89 | 89 | 90 | 91 |
| 17.75 | 1433 | 1558 | 92 | 93 | 90 | 90 | 90 | 91 |
| 18 | 1436 | 1556 | 93 | 92 | 89 | 92 | 90 | 91 |
| 18.25 | 1439 | 1570 | 92 | 96 | 90 | 92 | 90 | 92 |
| 18.5 | 1442 | 1547 | 92 | 94 | 89 | 90 | 92 | 92 |
| 18.75 | 1445 | 1560 | 91 | 94 | 89 | 89 | 91 | 91 |
| 19 | 1448 | 1555 | 91 | 98 | 89 | 89 | 91 | 92 |
| 19.25 | 1451 | 1554 | 92 | 97 | 89 | 90 | 92 | 91 |
| 19.5 | 1454 | 1556 | 92 | 97 | 90 | 90 | 93 | 92 |
| 19.75 | 1457 | 1569 | 91 | 97 | 90 | 90 | 92 | 92 |
| 20 | 1459 | 1564 | 91 | 97 | 90 | 89 | 91 | 92 |
| 20.25 | 1462 | 1575 | 91 | 97 | 91 | 90 | 93 | 92 |
| 20.5 | 1465 | 1576 | 93 | 99 | 90 | 91 | 93 | 92 |
| 20.75 | 1467 | 1571 | 93 | 96 | 91 | 92 | 91 | 93 |
| 21 | 1470 | 1576 | 94 | 98 | 90 | 92 | 93 | 92 |
| 21.25 | 1473 | 1560 | 94 | 96 | 90 | 92 | 93 | 92 |
| 21.5 | 1475 | 1572 | 93 | 101 | 91 | 91 | 93 | 93 |
| 21.75 | 1478 | 1581 | 92 | 97 | 91 | 90 | 92 | 93 |
| 22 | 1480 | 1544 | 92 | 97 | 91 | 90 | 92 | 93 |
| 22.25 | 1483 | 1548 | 92 | 96 | 91 | 91 | 92 | 93 |

TABLE 3-continued

| Time (min) | E119 Std Average (° F.) | Burn Room (° F.) | Pass/Fail TC#49 | Pass/Fail TC#50 | Pass/Fail TC#51 | Pass/Fail TC#52 | Pass/Fail TC#53 | Pass/Fail TC#54 |
|---|---|---|---|---|---|---|---|---|
| 22.5 | 1485 | 1551 | 95 | 99 | 92 | 91 | 92 | 93 |
| 22.75 | 1488 | 1549 | 95 | 101 | 92 | 92 | 93 | 93 |
| 23 | 1490 | 1557 | 96 | 101 | 91 | 92 | 93 | 93 |
| 23.25 | 1493 | 1554 | 95 | 101 | 92 | 92 | 92 | 93 |
| 23.5 | 1495 | 1553 | 94 | 100 | 92 | 92 | 94 | 93 |
| 23.75 | 1497 | 1569 | 94 | 99 | 93 | 92 | 92 | 94 |
| 24 | 1499 | 1586 | 95 | 101 | 93 | 92 | 94 | 94 |
| 24.25 | 1502 | 1591 | 97 | 99 | 93 | 94 | 94 | 94 |
| 24.5 | 1504 | 1582 | 97 | 99 | 93 | 94 | 95 | 94 |
| 24.75 | 1506 | 1599 | 94 | 100 | 93 | 93 | 96 | 94 |
| 25 | 1508 | 1589 | 96 | 99 | 94 | 92 | 96 | 94 |
| 25.25 | 1511 | 1607 | 96 | 98 | 93 | 93 | 94 | 94 |
| 25.5 | 1513 | 1643 | 96 | 98 | 95 | 95 | 93 | 95 |
| 25.75 | 1515 | 1627 | 95 | 100 | 95 | 94 | 94 | 95 |
| 26 | 1517 | 1637 | 95 | 98 | 94 | 94 | 94 | 94 |
| 26.25 | 1519 | 1634 | 99 | 97 | 96 | 95 | 94 | 95 |
| 26.5 | 1521 | 1653 | 98 | 98 | 95 | 96 | 94 | 95 |
| 26.75 | 1523 | 1633 | 96 | 102 | 96 | 93 | 94 | 95 |
| 27 | 1525 | 1650 | 97 | 103 | 96 | 94 | 96 | 95 |
| 27.25 | 1527 | 1654 | 97 | 102 | 95 | 94 | 97 | 96 |
| 27.5 | 1529 | 1666 | 96 | 101 | 96 | 94 | 95 | 96 |
| 27.75 | 1531 | 1662 | 98 | 100 | 96 | 93 | 94 | 95 |
| 28 | 1533 | 1674 | 99 | 98 | 97 | 95 | 94 | 96 |
| 28.25 | 1535 | 1668 | 97 | 100 | 95 | 94 | 95 | 95 |
| 28.5 | 1537 | 1657 | 97 | 99 | 99 | 94 | 95 | 96 |
| 28.75 | 1539 | 1672 | 97 | 99 | 97 | 94 | 96 | 95 |
| 29 | 1541 | 1671 | 102 | 101 | 98 | 95 | 95 | 96 |
| 29.25 | 1543 | 1668 | 98 | 101 | 100 | 94 | 95 | 96 |
| 29.5 | 1545 | 1670 | 96 | 100 | 100 | 94 | 95 | 97 |
| 29.75 | 1547 | 1676 | 98 | 100 | 99 | 95 | 95 | 97 |
| 30 | 1549 | 1675 | 97 | 99 | 97 | 97 | 95 | 95 |
| 30.25 | 1550 | 1445 | 99 | 99 | 98 | 97 | 95 | 96 |
| 30.5 | 1552 | 1215 | 99 | 101 | 98 | 95 | 96 | 96 |
| 30.75 | 1554 | 1111 | 98 | 102 | 99 | 95 | 96 | 96 |
| 31 | 1556 | 1034 | 100 | 102 | 98 | 96 | 98 | 95 |
| 31.25 | 1558 | 983 | 98 | 105 | 98 | 94 | 97 | 96 |
| 31.5 | 1559 | 939 | 96 | 104 | 98 | 94 | 98 | 95 |
| 31.75 | 1561 | 906 | 98 | 104 | 98 | 94 | 98 | 95 |
| 32 | 1563 | 873 | 97 | 102 | 99 | 95 | 97 | 96 |
| 32.25 | 1565 | 847 | 98 | 100 | 99 | 94 | 96 | 96 |
| 32.5 | 1566 | 820 | 98 | 100 | 101 | 95 | 97 | 97 |
| 32.75 | 1568 | 800 | 97 | 99 | 100 | 95 | 97 | 97 |
| 33 | 1570 | 777 | 99 | 100 | 100 | 97 | 97 | 97 |
| 33.25 | 1571 | 760 | 101 | 101 | 100 | 97 | 97 | 97 |
| 33.5 | 1573 | 742 | 98 | 101 | 99 | 96 | 97 | 97 |
| 33.75 | 1575 | 727 | 100 | 103 | 100 | 95 | 98 | 96 |
| 34 | 1576 | 710 | 97 | 104 | 100 | 95 | 98 | 96 |
| 34.25 | 1578 | 697 | 99 | 103 | 102 | 95 | 97 | 97 |
| 34.5 | 1579 | 683 | 99 | 103 | 101 | 95 | 97 | 97 |
| 34.75 | 1581 | 671 | 99 | 101 | 101 | 94 | 97 | 97 |
| 35 | 1583 | 658 | 97 | 100 | 101 | 93 | 95 | 97 |
| 35.25 | 1584 | 648 | 97 | 101 | 100 | 94 | 96 | 98 |
| 35.5 | 1586 | 637 | 97 | 102 | 99 | 94 | 96 | 96 |
| 35.75 | 1587 | 627 | 99 | 101 | 100 | 97 | 96 | 97 |
| 36 | 1589 | 617 | 100 | 100 | 99 | 97 | 96 | 97 |
| 36.25 | 1590 | 608 | 99 | 100 | 99 | 97 | 96 | 97 |
| 36.5 | 1592 | 599 | 98 | 102 | 100 | 94 | 97 | 97 |
| 36.75 | 1593 | 591 | 100 | 105 | 99 | 95 | 98 | 97 |
| 37 | 1595 | 582 | 99 | 104 | 100 | 94 | 98 | 97 |
| 37.25 | 1596 | 575 | 97 | 103 | 100 | 95 | 98 | 97 |
| 37.5 | 1598 | 566 | 98 | 102 | 101 | 96 | 98 | 97 |
| 37.75 | 1599 | 559 | 98 | 103 | 99 | 94 | 96 | 96 |
| 38 | 1601 | 552 | 98 | 102 | 100 | 94 | 97 | 96 |
| 38.25 | 1602 | 545 | 99 | 103 | 100 | 95 | 99 | 96 |
| 38.5 | 1604 | 539 | 98 | 104 | 99 | 94 | 99 | 96 |
| 38.75 | 1605 | 533 | 99 | 106 | 100 | 95 | 98 | 95 |
| 39 | 1606 | 526 | 98 | 104 | 101 | 94 | 97 | 96 |
| 39.25 | 1608 | 519 | 97 | 101 | 100 | 94 | 96 | 96 |
| 39.5 | 1609 | 513 | 97 | 100 | 100 | 94 | 95 | 96 |
| 39.75 | 1611 | 508 | 97 | 101 | 101 | 93 | 96 | 95 |
| 40 | 1612 | 502 | 97 | 104 | 100 | 93 | 98 | 96 |

Based upon the thermocouple data in Tables 1-3, the illustrative embodiment described above achieved the NFPA 285 standard.

A further illustrative embodiment of the exterior finishing system with continuous insulation was tested in accordance with the guidelines set forth in NFPA 285 (National Fire Protection Association). NFPA 285 discloses the standard test method for the evaluation of fire propagation characteristics of exterior non-load-bearing wall assemblies containing combustible components. The illustrative embodiment comprised a trim bead; an exterior building wall comprised of a frame with an exterior surface; a weather resistant barrier attached to the wall; an insulation layer attached to the wall; a lath attached to the insulation layer; and a stucco coating.

The assembly was secured to the test laboratory's intermediate-scale multi-story test apparatus (ISMA) with ceramic fiber insulation installed between the assembly and the furnace to create an effective seal. The window burner was centered on the vertical centerline of the window, 9" below the top of the opening and with the longitudinal centerline of the burner 3" from the plane of the exterior wall. The assembly was tested to the time-temperature curve described in the NFPA 285 standard using commercial grade propane.

An 18 foot high (×13 foot−4 inch) test wall was constructed from steel studs, gypsum board, exterior sheathing, expanded polystyrene foam insulation, vinyl trim bead, and a stucco façade. The studs were 3⅝" 20 galvanized steel studs spaced 16" on center installed with the long dimension perpendicular to the studs and fastened to the framing with #6×1¼" self-drill zinc-plated screws spaced 8" on center around the perimeter and 12" on center in the field. The exterior sheathing was 4'×8'×½" American Gypsum Exterior sheathing installed over the exterior side with the long edge perpendicular to the studs and secured with #6×1¼" self-drilled zinc-plated screws spaced at 8" on center around the perimeter and in the field. The felt paper was Tamko No. 15 ASTM Organic Felt (ASTM D226, type 1) and was installed horizontally with 4" minimum overlap at the seams and secured with staples. PVC extrusions were attached around the window opening using lath screws. PVC corner bead was installed at all corners and expansion and control joint components were installed into the expansion and control joints. The expanded polystyrene board was 2'×8'×2½" Type board (density 1.33 pcf) and was installed horizontally using screws and Wind-Lock lath-plate fasteners positioned to hold the panels in place. The exterior surface was installed by using PERMALATH 1000 glass fiber lath installed horizontally with a minimum of 3" overlap at the seams. A nominal ½" thick layer of StuccoBase Premix (BASF Corporation) was applied using a ½" control joint from upper left corner of the window to top of the assembly as a guide. A skim coat of StuccoBase Premix was applied and a finish coat of Senergy Senerflex Sahara 3025 (BASF Corporation).

Fifty-four (54) Type K, fiberglass jacketed thermocouples were installed within the wall system according to NFPA 285. The thermocouple data was monitored every fifteen (15) seconds by a 100-channel Yokogawa, Inc., Darwin Data Acquisition Unit. Testing was conducted in accordance with the applicable requirements of and following the standard methods of NFPA No. 285 Standard Test Method for Evaluation of Fire Propagation Characteristics of Exterior Non-Load-Bearing Wall Assemblies Containing Combustible Components, 2012 Edition.

Temperature data from twenty-four (24) of the thermocouples were used to determine compliance with the NFPA 285 standard. Thermocouples 11, and 14-17 were positioned on the exterior wall surface. Thermocouples 18, 19, 28, and 31-40 were positioned within the exterior finishing system core. Thermocouples 49-54 were positioned on the second floor interior wall surface. Compliance with the NFPA standard required that thermocouples 11, and 14-17 not exceed 1000° F., thermocouples 18, 19, 28, and 31-40 not measure a temperature rise of greater than 750° F., and thermocouples 49-54 not measure a rise over 500° F. The ambient temperature at the time of the test was 79° C. and the relative humidity was 69%. The results are summarized in Tables 4-8. The top row in each of Tables 4-8 refers to the thermocouple number of the thermocouples used in the test. The bottom row in each of Tables 4-8 represents the maximum temperature experienced at the thermocouple (in degrees Fahrenheit) during the test procedure.

TABLE 4

| TC#1 | TC#2 | TC#3 | TC#4 | TC#5 | TC#6 | TC#7 | TC#8 | TC#9 | TC#10 | TC#11 | TC#12 | TC#13 |
|---|---|---|---|---|---|---|---|---|---|---|---|---|
| 1240 | 1435 | 1430 | 1387 | 1220 | 1071 | 1162 | 1016 | 948 | 872 | 815 | 760 | 723 |

TABLE 5

| TC#14 | TC#15 | TC#16 | TC#17 | TC#18 | TC#19 | TC#20 | TC#21 | TC#22 | TC#23 | TC#24 | TC#25 | TC#26 |
|---|---|---|---|---|---|---|---|---|---|---|---|---|
| 176 | 461 | 443 | 218 | 157 | 132 | 883 | 730 | 671 | 692 | 650 | 594 | 525 |

TABLE 6

| TC#27 | TC#28 | TC#29 | TC#30 | TC#31 | TC#32 | TC#33 | TC#34 | TC#35 | TC#36 | TC#37 | TC#38 | TC#39 |
|---|---|---|---|---|---|---|---|---|---|---|---|---|
| 480 | 322 | 416 | 339 | 124 | 144 | 118 | 116 | 210 | 117 | 117 | 119 | 122 |

TABLE 7

| TC#40 | TC#41 | TC#42 | TC#43 | TC#44 | TC#45 | TC#46 | TC#47 | TC#48 | TC#49 | TC#50 | TC#51 | TC#52 |
|---|---|---|---|---|---|---|---|---|---|---|---|---|
| 210 | 1708 | 1721 | 1575 | 1367 | 1403 | 1621 | 1690 | 1710 | 89 | 91 | 95 | 93 |

TABLE 8

| TC#53 | TC#54 |
|---|---|
| 92 | 90 |

Flames seen on the exterior panels were within established limits during the test. There were no flames that spread through the core components or infiltrated into the interior second story of the test structure. None of the thermocouples exceeded their maximum limits. Based upon the thermocouple data in Tables 4-, the illustrative embodiment of the exterior wall systems with continuous insulation tested above achieved the NFPA 285 standard.

While the trim bead, exterior finish system, stucco system, building wall, and related methods have been described in connection with various embodiments, as shown in the various figures, it is to be understood that other similar embodiments may be used or modifications and additions may be made to the described embodiments for performing the same function. Furthermore, the various illustrative embodiments may be combined to produce the desired results. Therefore, the trim bead, exterior finish system, stucco system, building wall, and related processes should not be limited to any single embodiment, but rather construed in breadth and scope in accordance with the recitation of the appended claims.

The invention claimed is:

1. A trim bead for a building wall comprising:

spaced-apart front and rear walls;

a bottom wall connecting the front and rear walls, said bottom wall having a first protrusion that extends horizontally beyond said front wall;

a flange portion extending substantially horizontally from said front wall, wherein said flange includes a plurality of openings communicating through the thickness of said flange; and a second protrusion extending horizontally from said front wall and positioned between said first protrusion and said horizontally extending flange portion of said trim bead.

2. The trim bead of claim 1, wherein said bottom wall comprises at least one weep hole.

3. The trim bead of claim 1, wherein said rear wall comprises at least one opening communicating at least partially through the thickness of the rear wall.

4. The trim bead of claim 1, wherein said flange comprises a mesh, diamond mesh, or ribbed structure.

5. The trim bead of claim 1, wherein said flange is perforated, stamped, or expanded.

6. The trim bead of claim 1, wherein said trim bead comprises polymer material, a metal material, a metal alloy material, or composite material.

7. The trim bead of claim 1, wherein said horizontally extending flange extends beyond the front edge of said first and second protrusions.

8. The trim bead of claim 1, wherein said second protrusion is positioned in a spaced-apart relationship between the bottom wall and the horizontally extending flange portion of the trim bead.

9. The trim bead of claim 1, wherein said first protrusion and spaced-apart second protrusion extend substantially parallel to each other along the length of the longitudinal axis of the trim bead.

10. An exterior finish system for a building wall comprising:

a trim bead comprising spaced-apart front and rear walls, a bottom wall connecting said front and rear walls, said bottom wall having a first protrusion that extends horizontally beyond said front wall, a flange portion extending substantially horizontally from the front wall, wherein said flange includes a plurality of openings communicating through the thickness of the flange, and a second protrusion extending horizontally from the front wall and positioned between said first protrusion and said horizontally extending flange portion of the trim bead;

an insulation layer; and at least one layer of an exterior finishing coating applied to the insulation layer and the flange of the trim bead.

11. The exterior finish system of claim 10, wherein said bottom wall comprises at least one weep hole.

12. The exterior finish system of claim 11, wherein said rear wall comprises at least one opening communicating at least partially through the thickness of the rear wall.

13. The exterior finish system of claim 10, wherein said flange comprises a mesh, a diamond mesh, or a ribbed structure.

14. The exterior finish system of claim 10, wherein said flange is perforated, stamped, or expanded.

15. The exterior finish system of claim 10, wherein said trim bead comprises polymer material, a metal material, a metal alloy material, or composite material.

16. The exterior finishing system of claim 10, further comprising a weather resistive barrier.

17. The exterior finishing system of claim 10, further comprising a reinforcement layer attached to said insulation layer for holding exterior finishing coatings.

18. The exterior finishing system of claim 10 wherein said exterior finishing coatings comprise at least one layer of stucco.

19. The exterior finish system of claim 10, wherein said horizontally extending flange extends beyond the front edge of said first and second protrusions.

20. The exterior finish system of claim 10, wherein said second protrusion is positioned in a spaced-apart relationship between the bottom wall and the horizontally extending flange portion of the trim bead.

21. The exterior finish system of claim 10, wherein said first protrusion and spaced-apart second protrusion extend substantially parallel to each other along the length of the longitudinal axis of the trim bead.

22. The exterior finish system of claim 10, further comprising a weather resistive barrier.

23. A building wall comprising:

a frame;

a building wall substrate attached to the frame;

a trim bead attached to the building substrate, said trim bead comprising spaced-apart front and rear walls, a bottom wall connecting the front and rear walls, said bottom wall having a first protrusion that extends horizontally beyond said front wall, a flange portion extending substantially horizontally from said front wall, wherein said flange includes a plurality of openings communicating through the thickness of said flange, and a second protrusion extending horizontally from said front wall and positioned between said first protrusion and said horizontally extending flange portion of said trim bead;

an insulation layer adjacent the trim bead and attached to said frame;

and at least one layer of an exterior finishing coating applied to the insulation layer and the flange of the trim bead.

24. The building wall of claim 23, further comprising a reinforcement layer attached to said insulation layer.

25. The building wall of claim 24, wherein said reinforcement layer comprises a lath.

26. The building wall of claim 25, wherein said exterior finishing coating comprises: at least one layer of a stucco coating applied to the insulation layer, a lath, and the flange of the trim bead.

27. The building wall of claim 23, wherein said horizontally extending flange extends beyond the front edge of said first and second protrusions.

28. The building wall of claim 23, wherein said second protrusion is positioned in a spaced-apart relationship between the bottom wall and the horizontally extending flange portion of the trim bead.

29. The building wall of claim 23, wherein said first protrusion and spaced-apart second protrusion extend substantially parallel to each other along the length of the longitudinal axis of the trim bead.

* * * * *